US007845532B2

(12) United States Patent
Burke et al.

(10) Patent No.: US 7,845,532 B2
(45) Date of Patent: Dec. 7, 2010

(54) CORDLESS FASTENER DRIVING DEVICE

(75) Inventors: Brian C. Burke, Barrington, RI (US); Charles W. Hewitt, Warwick, RI (US); Donald R. Perron, North Smithfield, RI (US); David M. McGee, Attleboro, MA (US); Matthew B. Ponko, Cranston, RI (US); Prudencio S. Canlas, Jr., North Kingstowne, RI (US)

(73) Assignee: Stanley Fastening Systems, L.P., Greenwich, RI (US)

( * ) Notice: Subject to any disclaimer, the term of this patent is extended or adjusted under 35 U.S.C. 154(b) by 0 days.

(21) Appl. No.: 11/937,665

(22) Filed: Nov. 9, 2007

(65) Prior Publication Data

US 2008/0135598 A1 Jun. 12, 2008

Related U.S. Application Data

(60) Provisional application No. 60/857,772, filed on Nov. 9, 2006.

(51) Int. Cl.
*B25C 1/04* (2006.01)

(52) U.S. Cl. ..... 227/130; 227/8

(58) Field of Classification Search ..... 227/8, 227/130, 178.1; 137/71; 173/169
See application file for complete search history.

(56) References Cited

U.S. PATENT DOCUMENTS

| | | | | |
|---|---|---|---|---|
| 556,058 | A | | 3/1896 | Huey |
| 1,358,296 | A | | 11/1920 | Csanyi |
| 1,633,357 | A | | 6/1927 | Albertine |
| 2,897,782 | A | | 8/1959 | Kennedy |
| 2,899,864 | A | | 8/1959 | Bloxzom, Jr. |
| 2,964,752 | A | | 12/1960 | Kopf |
| 3,049,712 | A | | 8/1962 | Khan |
| 3,059,814 | A | * | 10/1962 | Poncel et al. ..... 222/5 |
| 3,170,487 | A | * | 2/1965 | Juilfs et al. ..... 137/625.6 |
| 3,250,334 | A | | 5/1966 | Sussman |
| 3,283,986 | A | | 11/1966 | McKee |
| 3,438,449 | A | | 4/1969 | Smith |
| 3,643,851 | A | | 2/1972 | Green et al. |

(Continued)

FOREIGN PATENT DOCUMENTS

| | | |
|---|---|---|
| DE | 3309226 | 9/1984 |

(Continued)

OTHER PUBLICATIONS

Nico Pneumatics, http://65.13.30.67/nicopneumatics/, Feb. 1, 2006.

*Primary Examiner*—Rinald I. Rada
*Assistant Examiner*—Nathaniel Chukwurah
(74) *Attorney, Agent, or Firm*—Pillsbury Winthrop Shaw Pittman LLP

(57) ABSTRACT

A fastener driving device includes various interconnected systems within a device housing for efficiently regulating and transferring compressed gas provided by user-replaceable cartridges to drive a fastener securely into a workpiece. An improved cartridge containment system is provided for loading and securing compressed gas cartridges. An improved gas management system is provided, including an improved multi-function regulator, for managing gas flow. An improved valve system is provided for controlling gas flow, including an improved valve module. An improved drive system is provided for efficiently using compressed gas to drive fasteners.

31 Claims, 32 Drawing Sheets

U.S. PATENT DOCUMENTS 3,662,939 A 5/1972 Bryan
3,815,476 A 6/1974 Green et al.
3,837,555 A 9/1974 Green
3,871,566 A 3/1975 Elliesen et al.
3,912,022 A 10/1975 Smith
3,939,816 A 2/1976 Espy
3,964,659 A * 6/1976 Eiben et al. ..... 227/8
3,967,771 A 7/1976 Smith
4,034,497 A 7/1977 Yanda
4,181,139 A * 1/1980 Martini ..... 137/68.13
4,211,352 A 7/1980 Zilka
4,331,277 A 5/1982 Green
4,370,997 A * 2/1983 Braithwaite et al. ..... 137/116.3
4,540,110 A 9/1985 Bent et al.
4,590,842 A 5/1986 Goldstein et al.
4,658,699 A 4/1987 Dahm
4,658,913 A 4/1987 Yantsen et al.
4,688,645 A 8/1987 Müller
4,711,154 A 12/1987 Chryssomallis et al.
4,715,261 A 12/1987 Goldstein et al.
4,744,387 A * 5/1988 Otteman ..... 137/505.41
4,913,029 A 4/1990 Tidman et al.
4,938,408 A 7/1990 Bedi et al.
4,951,861 A 8/1990 Schulze et al.
4,966,183 A * 10/1990 Williamson, Jr. ..... 137/116.5
4,974,487 A 12/1990 Goldstein et al.
5,012,719 A 5/1991 Goldstein et al.
5,018,657 A 5/1991 Pedlick et al.
5,078,117 A 1/1992 Cover
5,080,018 A 1/1992 Reuter
5,115,743 A 5/1992 Löffler
5,329,685 A 7/1994 Gillespie
5,339,517 A 8/1994 Diemer
5,346,021 A * 9/1994 Braunlich ..... 173/177
5,355,764 A 10/1994 Marinos et al.
5,431,322 A 7/1995 Green et al.
5,462,042 A 10/1995 Greenwell
5,476,205 A * 12/1995 Canlas et al. ..... 227/130
5,487,499 A 1/1996 Sorrentino et al.
5,544,670 A 8/1996 Phillips et al.
5,562,240 A 10/1996 Campbell
5,586,569 A * 12/1996 Hanning et al. ..... 137/116.5
5,613,483 A * 3/1997 Lukas et al. ..... 124/73
5,652,405 A 7/1997 Rakov
5,657,921 A 8/1997 Young et al.
5,703,322 A 12/1997 Tidman
5,706,795 A 1/1998 Gerwig
5,712,442 A 1/1998 Lee et al.
5,782,397 A 7/1998 Koukline
5,789,696 A 8/1998 Lee et al.
5,884,405 A 3/1999 Breeden
5,909,001 A 6/1999 Goldstein
5,957,119 A * 9/1999 Perry et al. ..... 124/73
5,962,805 A 10/1999 Saxby
5,988,070 A 11/1999 Krumm et al.
5,996,597 A 12/1999 Gallo
6,125,834 A 10/2000 Ciccarelli et al.
6,131,787 A 10/2000 Curtis
6,220,496 B1 4/2001 Nirai et al.
6,223,966 B1 5/2001 Nayrac et al.
6,318,268 B1 11/2001 Machata et al.
6,387,113 B1 * 5/2002 Hawkins et al. ..... 606/219
6,454,152 B1 9/2002 Nayrac et al.
6,481,454 B2 * 11/2002 Hope et al. ..... 137/116.3
6,526,852 B2 3/2003 Rahmsdorf et al.
6,568,418 B1 * 5/2003 Hope et al. ..... 137/116.3
6,786,379 B2 9/2004 Largo
6,843,388 B1 1/2005 Hollars
6,845,896 B2 * 1/2005 Kral ..... 227/130
6,877,647 B2 4/2005 Green et al.
6,922,854 B2 8/2005 Allenbaugh et al.
6,932,128 B2 8/2005 Turan, Jr.
7,063,247 B1 * 6/2006 Lund et al. ..... 227/10
2002/0151842 A1 10/2002 Gonnelli et al.
2002/0156418 A1 10/2002 Gonnelli et al.
2002/0158102 A1 10/2002 Patton et al.
2003/0111136 A1 6/2003 Vallon et al.
2005/0111995 A1 5/2005 Everson
2005/0252944 A1 11/2005 Patrick
2006/0032647 A1 2/2006 Petty
2006/0102365 A1 5/2006 Phillips et al.

FOREIGN PATENT DOCUMENTS

DE 3730048 3/1989
DE 3730049 A1 3/1989
EP 0191186 A2 8/1986
EP 1325796 A2 7/2003
JP 2001-001279 1/2001
JP 2001-162554 6/2001
JP 2002-059374 2/2002
JP WO-03/038367 A1 5/2003
JP 2003-211366 A 7/2003
WO WO-03/002308 A1 1/2003
WO WO-03/037570 A1 5/2003
WO WO-03/042717 A1 5/2003
WO WO 2005/115695 A1 12/2005

* cited by examiner

CORDLESS FASTENER DRIVING DEVICE

BACKGROUND OF THE INVENTION

1. Field of the Invention

The general field of the invention is directed towards a fastener driving device for driving fasteners into a workpiece. In particular, the general field of the invention is directed to such a cordless fastener driving device that utilizes compressed gas cartridges for driving fasteners.

2. Description of Related Art

Fastener driving devices are designed to deliver energy stored in an energy source to drive fasteners very quickly into a workpiece. For example, some fastener driving devices use compressed air as an energy source, wherein the fastener driving device is tethered to an air compressor by an air hose. In addition, other fastener driving devices use hydrocarbon combustible gases or springs as an energy source. However, further improvements are desirable.

DETAILED DESCRIPTION OF THE PREFERRED EMBODIMENT

Figure 1:
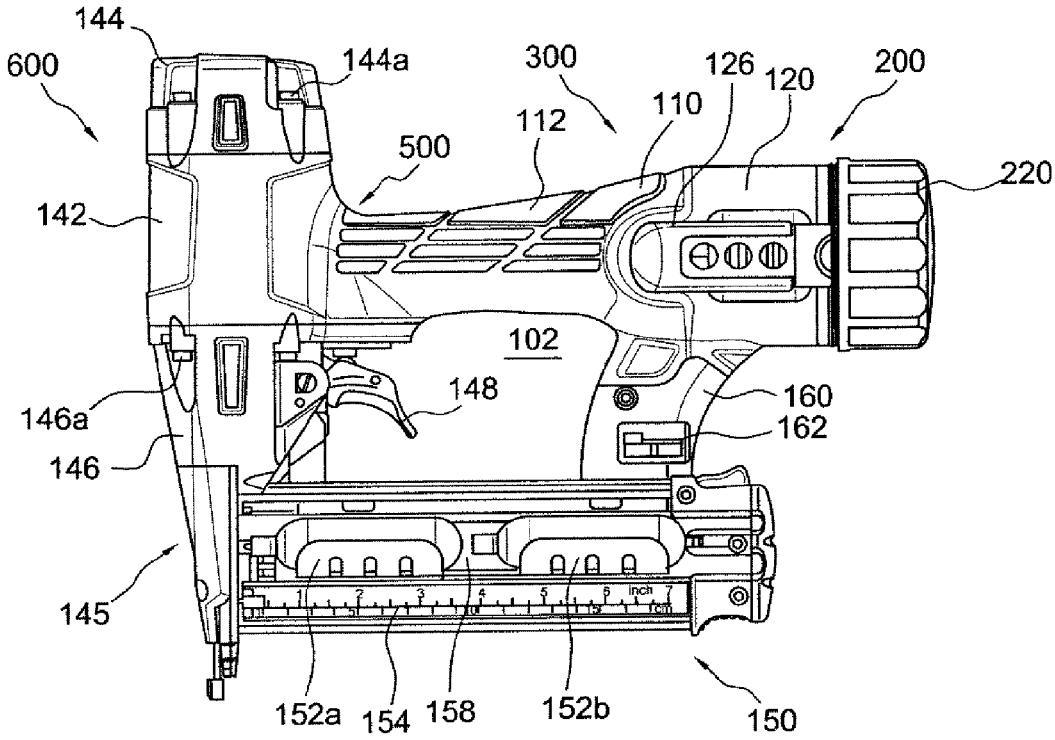
FIG. 1 is a first side view of an exemplary cordless fastener driving device according to the present invention.
Figure 2:
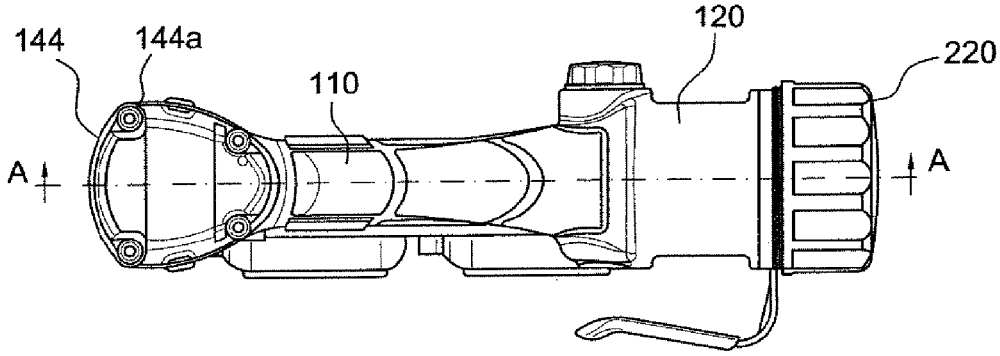
FIG. 2 is a top view of the cordless fastener driving device of FIG. 1 according to the present invention.
Figure 4:
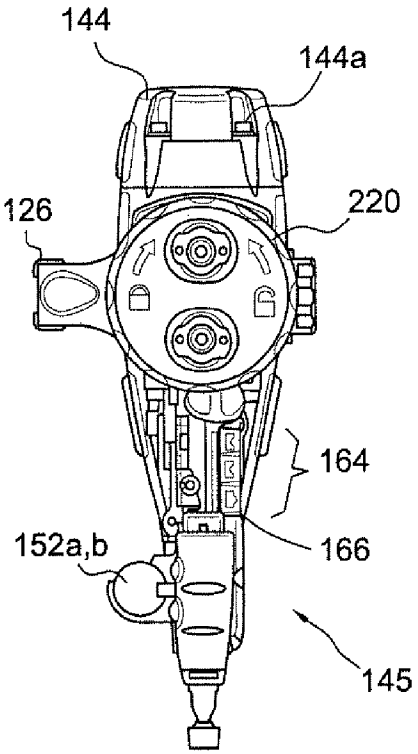
FIG. 4 is a rear view of the cordless fastener driving device of FIG. 1 according to the present invention.
Figure 3:
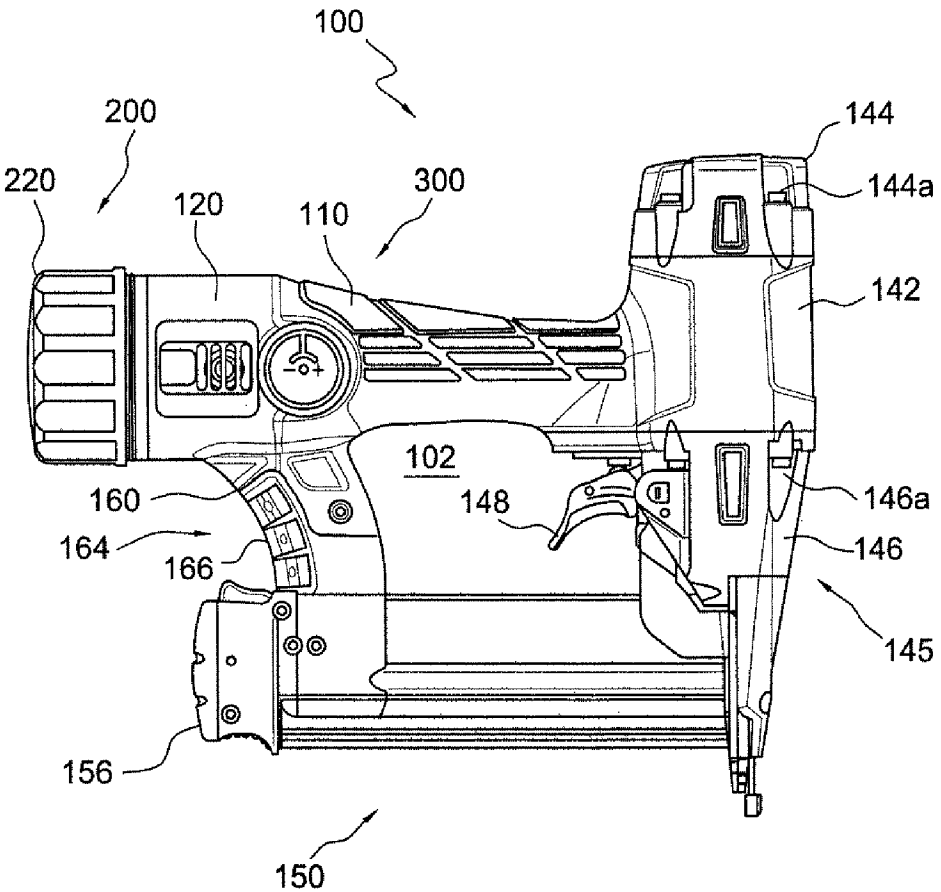
FIG. 3 is a second side view of the cordless fastener driving device of FIG. 1 according to the present invention.

As shown in the drawings, an exemplary cordless fastener driving device 100 embodying the principles of the present invention operates to efficiently and effectively drive fasteners into a workpiece. In FIG. 1, the fastener driving device 100 includes a device body 110 and a cartridge containment system 200, a gas management system 300, a valve system 500, a fastener drive engine 600, a magazine system 150, and a nose assembly 145, which are each mounted in and/or on device body 110. While the device could be adapted to drive any type of fastener, as shown, device 100 is particularly adapted to drive nails which are supplied in the form of collated fasteners positioned in magazine system 150. In addition, each of the various systems and components of the present invention may be implemented in combination with otherwise conventional tools, exclusive of the other systems and components of the present invention, or implemented in various combinations, but are presented herein implemented together in driving device 100 to show an exemplary embodiment of the present invention.

Figure 5:
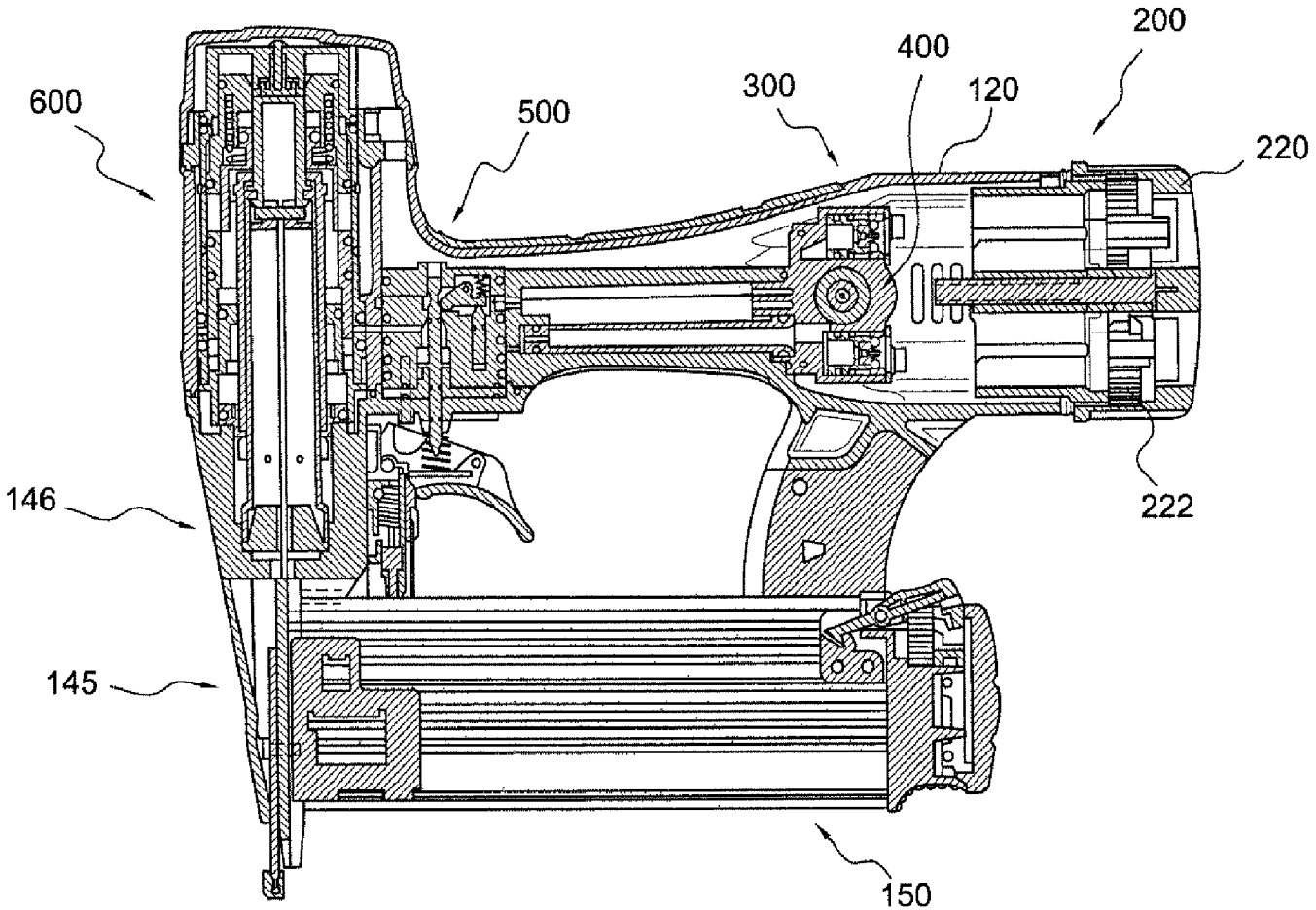
FIG. 5 is a cross-sectional view along A-A of FIG. 2 according to the present invention.

Referring to FIGS. 1-4, device body 110 includes a primary housing section 120 including an external gripping surface 112 positioned on a handle portion between fastener drive engine 600 and cartridge containment system 200 for improved gripping by a user's hand. As shown in FIG. 5, primary housing section 120 includes a corresponding internal housing structure, as discussed in detail below. As discussed more fully hereinbelow, cartridge containment system 200 (FIG. 5) includes a containment knob 220 operably attached to primary housing section 120. A belt hook 126 is mounted on one end of device body 110 adjacent containment knob 220 for supporting driving device 100 on a tool belt or other support.

Device body 110 includes an engine housing section 142, an engine cap 144, mounted to section 142 via fasteners 144*a*, and a nose assembly section 146 mounted to section 142 via fasteners 146*a*. A trigger assembly 148 is mounted on nose assembly housing 146 to permit actuation of fastener driving device 100 by a user. Device body 110 also includes a magazine section 158 extending from nose assembly housing 146 generally parallel to primary housing section 120, and a magazine bracket 160 extending transversely from, and between, primary housing section 120 and magazine section 158 to support magazine section 158 and to form an opening 102. A pair of reserve cartridge storage members 152*a* and 152*b* for storing spare compressed gas cartridges, and a ruled measuring system 154 may be mounted or formed on magazine section 158. Alternatively, reserve cartridge storage members 152*a* and 152*b* may be formed as single member. Magazine system 150 may be any conventional structure for receiving collated fasteners and mounted on magazine section 158. Magazine bracket 160 includes integrated ancillary devices 162, such as a pencil sharpening device 162, and a storage section 164 (FIG. 2) for storing additional no-mar tips 166.

In FIGS. 1-4, the device body 110 may be a unitary molded structure to include primary housing section 120, engine housing section 142, and magazine bracket 160. In addition, the nose assembly housing 146 and engine cap 144 may also be formed having a molded outer housing structure.

Figure 6A:
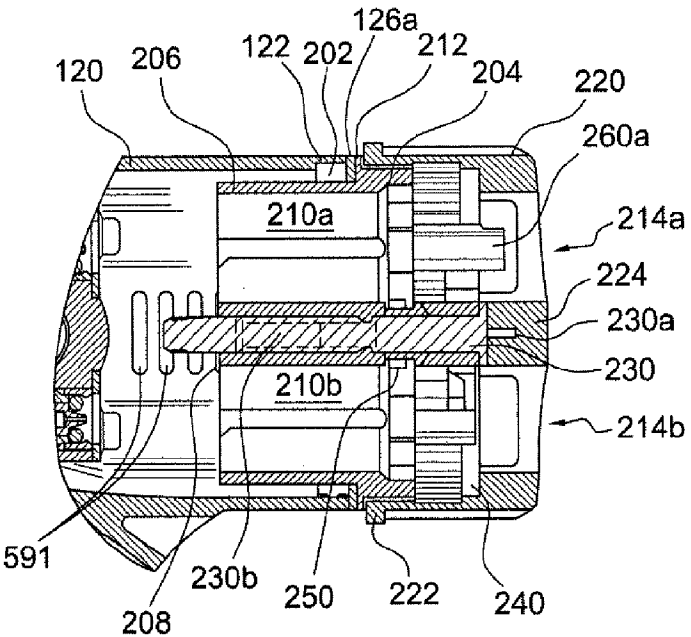
FIGS. 6A and 6B are enlarged sectional views of FIG. 5 according to the present invention.

Referring to FIGS. 5 and 6A, fastener driving device 100 includes an exemplary cartridge containment system 200 that is mounted on primary housing section 120 (FIG. 1). Specifically, cartridge containment system 200 includes a cartridge housing member 204 having an outer portion 206 surrounding a central inner portion 208, and sized to fit within and extend into primary housing section 120.

Although not specifically shown, cartridge housing member 204 is attached to primary housing section 120 using fasteners 209 (FIG. 7C) extending through cartridge housing member 204 into screw bosses molded into primary housing section 120, and includes a frictional fit member 250 between outer portion 206 of cartridge housing member 204 and an inner circumference of an end region of housing section 122. In addition, a flange portion 126*a* (FIG. 6A) of the belt hook 126 (FIGS. 1, 2, and 4) is disposed between the end region of housing section 122 and an outer annular flange 212 of cartridge housing member. 204. Cartridge housing member 204 includes first and second cylindrical compartments 210*a* and 210*b* for accommodating first and second compressed gas cartridges C1 and C2, respectively, (see FIG. 18A). In the exemplary embodiment, compartments 210*a* and 210*b* are preferably cylindrical shaped, but may be other shapes having surfaces to support and guide first and second cartridges.

Cartridge containment system 200 further includes containment knob 220 rotatably coupled to cartridge housing member 204 via a threaded feed fastener 230. Fastener 230 includes a first portion 230*a* fixedly connected to a central inner portion 224 of containment knob 220 and a second portion 230*b* threadably inserted into central inner portion 208 of cartridge housing member 204 having complementary threads to permit relative rotation between fastener 230 and cartridge housing member 204. Rotation of containment knob 220 causes threaded feed fastener 230 to advance into the primary housing section 120. Feed fastener 230 preferably includes a multi-start thread having a high pitch to decrease the number of turns or amount of rotation of containment knob 220 required to secure the cartridges in the lance assemblies. Containment knob 220 also includes openings 214*a* and 214*b* that can be aligned with cartridge compartments 210*a* and 210*b* so that cartridges C1 and C2 can be inserted therein, or misaligned so as to retain cartridges C1 and C2 in the device as described hereinbelow.

Figure 6B:
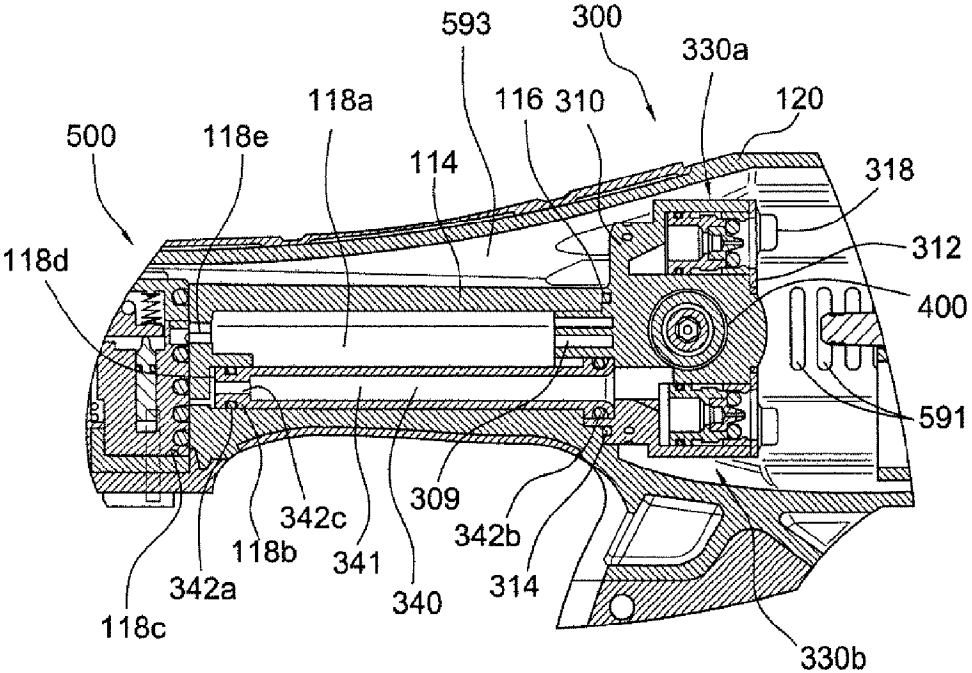
Figure 7C:
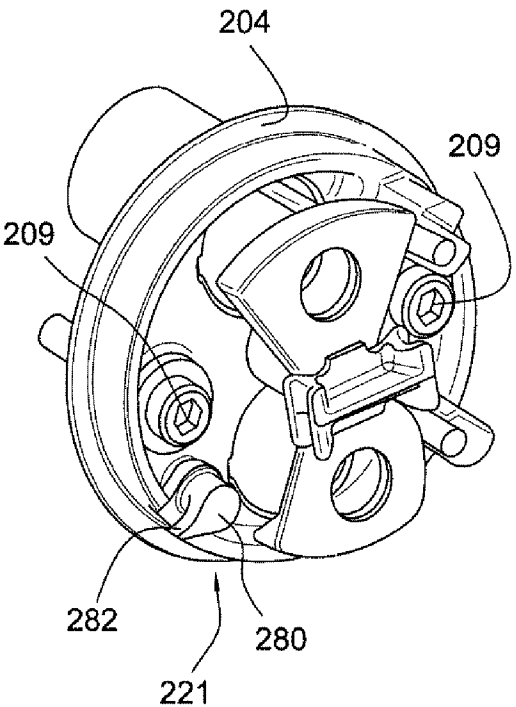
FIGS. 7A-7C are perspective cut away views of the exemplary cartridge containment system of FIGS. 5 and 6A according to the present invention.
Figure 7B:
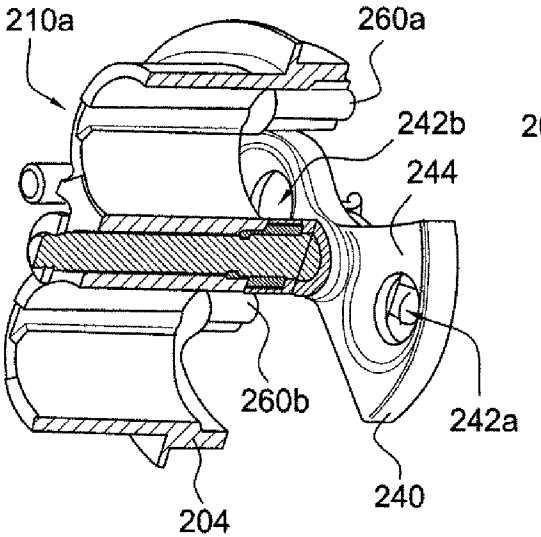
Figure 7A:
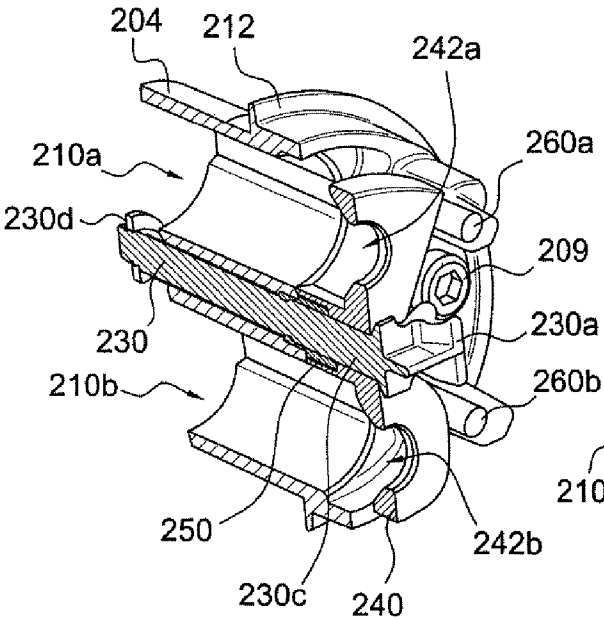

Referring to FIGS. 6A, 7A and 7B, cartridge containment system 200 further includes a containment plate 240 and containment plate locator or stop members 260*a* and 260*b*. Containment plate 240 is coupled to a third portion 230*c* of threaded feed fastener 230 via a frictional fitting member 250 that permits rotation of containment plate 240 relative to fastener 230 while axial movement of plate 240 is prevented by an end flange 230*d* formed on fastener 230. Accordingly, rotation of containment knob 220 (FIGS. 1-9) causes rotation of containment plate 240 due to frictional fitting member 250. In the preferred embodiment, containment plate 240 rotates between an open position and a closed position, wherein cartridges may be loaded and unloaded only in the open position. Containment plate locator members 260*a* and 260*b* are formed on cartridge housing member 204 for contact by edge portions of containment plate 240 so that locator member 260*a* defines the closed position while locator member 260*b* prevents rotational movement of plate 240 when in the open position, as discussed more fully hereinbelow. Thus, rotation of containment knob 220 toward the closed position (clockwise in FIG. 4) causes rotation of containment plate 240 in the clockwise direction until containment plate 240 abuts locator member 260*a* preventing further rotation of containment plate 240.

Referring to FIGS. 7A and 7B, containment plate 240 includes seating recesses 242*a* and 242*b* associated with cartridge compartments 210*a* and 210*b*, respectively, for receiving and supporting the outer ends of cartridges C1 and C2 when containment plate 240 is in the closed position. Containment plate 240 further includes lead-in surfaces 244 facing cartridge compartments 210*a* and 210*b*, as shown in FIG. 7B. Each lead-in surface 244 extends toward its respective seating surface thereby ensuring smooth relative movement between the ends of the cartridges and containment plate 240. Consequently, with cartridges C1 and C2 positioned in cartridge compartments 210*a* and 210*b*, during rotation of containment plate 240 from the open position of FIG. 7B to the closed position of FIG. 7A, the outer ends of cartridges C1, C2 are aligned with respective seating recess 242*a*, 242*b*. Also, locator member 260*b* is shorter than locator member 260*a* such that plate 240 moves over and clears member 260*b* during this rotational movement.

However, containment knob 220 (FIG. 4) continues to rotate relative to containment plate 240 after plate 240 contacts locator member 260*a*, thereby causing inward axial movement of knob 220 and plate 240. This relative rotation and the resulting axial movement of knob 220 and plate 240 functions to move containment plate 240 axially to place the cartridges into a secure, loaded position in their respective lance assemblies 330*a* and 330*b* (FIG. 6B), as detailed below. Once secured into the closed position, plate 240 safely maintains cartridges C1, C2 within their respective compartments 210*a*, 210*b* during operation of the fastener driving device 100 (FIGS. 1-5). In addition, when in the closed position, plate 240 is positioned to block axial movement of cartridges C1, C2 out of respective compartments 210*a*, 210*b* during opening of plate 240, as detailed below. The axial movement of the cartridges by rotation of knob 220, as well as lance assembly 330*b*, also accommodates cartridges having different tolerances, thereby ensuring an effective connection to the device.

Thus, in the closed position, first edge portions of containment plate 240 engage containment plate locator member 260*a* such that seating recesses 242*a* and 242*b* (FIG. 7A) of containment plate 240 are substantially aligned with first and second cartridge compartments 210*a* and 210*b*. Once knob 220 has been rotated to move plate 240 axially, a portion of plate 240 is positioned in a common transverse plane with locater member 260*b*. As a result, during rotation of knob 220 in the counterclockwise direction, although plate 240 will tend to move with knob 220, plate 240 will contact locator member 260*b* preventing rotation of plate 240. Recesses 242*a*, 242*b* also tend to prevent rotation of plate 240 as the outer ends of each cartridge contacts the recesses, thereby allowing knob 220 to continue to rotate, e.g. for several full turns. Thus, plate 240 moves axially outward allowing cartridges C1, C2 to back out of or move away from respective lance assemblies 320*a*, 320*b* thus safely and effectively disengaging the cartridges C1, C2 and venting the residual pressurized gas in cartridges C1, C2. In addition, any residual gas pressure can be used to push the cartridges off respective lances (FIGS. 18A, 18B) so the cartridges are positioned and ready for removal by dropping or sliding out of the compartments 210*a*, 210*b* under the sole force of gravity. Once plate 240 has moved axially outward sufficiently so as not to transversely overlap locator member 260*b* (not in the same plane), continued rotation of knob 220 by the user causes plate 240 to rotate counterclockwise past locator member 260*b* until plate 240 contacts locater member 260*a* as shown in FIG. 7B. In this open position, seating recesses 242*a* and 242*b* of containment plate 240 are substantially offset from first and second cartridge compartments 210*a*, 210*b* by about 90 degrees.

Referring to FIGS. 5 and 7C, containment knob 220 includes a ratchet system 221 for controlling rotational movement of containment knob 220. Ratchet system 221 includes an inner circumferential ring of detents/teeth 222 formed on an inner surface of containment knob 220 and a knob detent 280 disposed on the cartridge housing member 204. Knob detent 280 includes a flexible pawl 282 extending to engage detents/teeth 222. Flexible pawl 282 is biased against detents/teeth 222 and shaped to cause significantly greater restriction to rotational movement of containment knob 220 in the counter clockwise direction than the clockwise direction thereby minimizing the likelihood of inadvertent rotation of knob and movement of containment plate 240 from closed to open positions. Specifically, knob detent 280 is substantially stationary with respect to cartridge housing member 204, but flexible pawl 282 will flex along rotational directions of containment knob 220.

It should be noted that cartridge containment system 200 can be used with compressed gas cartridges of any size by sizing the compartments and other components of system 200 appropriately to accommodate the particular sized cartridges. Also the cartridge may use various types of compressed gas including carbon dioxide, nitrogen, argon, etc. In another embodiment, a single cartridge compartment may be implemented for receiving only one cartridge. Although the floating lance design may not be used in such an embodiment, the rotating containment knob and other features of the containment system and other components would still be applicable.

Referring to FIGS. 5 and 6B, fastener driving device 100 includes an exemplary gas management system 300 disposed within the primary housing section 120 to manage, regulate and direct regulated and unregulated flows of gas through housing section 120. Specifically, gas management system 300 includes a manifold 310, a regulator assembly 400, upper and lower lance assemblies 330*a* and 330*b*, a cavity housing 114, and a flow tube 340. Compressed gas from cartridges C1 and C2 enters into manifold 310 through upper and lower lance assemblies 330*a* and 330*b*, as will be explained below, and simultaneously flows into regulator assembly 400 and into a central passage 341 of flow tube 340 as an unregulated gas flow. The compressed gas flowing into regulator assembly 400 exits as a pressure regulated gas flow. Thus unregulated gas flow and unregulated gas pressure is used herein to describe gas that is approximately at the pressure of the gas exiting the cartridges, taking in account pressure losses in the system flow passages, and/or gas not passing through the pressure reduction portion of regulator assembly 400, while regulated gas flow and regulated gas pressure is used herein to describe gas that normally passes through regulator assembly 400 and is at a lower pressure than the unregulated gas pressure.

In FIG. 6B, manifold 310 is coupled to primary housing section 120 by primary housing attachment members 318. Specifically, although not completely shown, primary housing attachment members 318 extend through corresponding holes in a manifold plate 312, and through corresponding flange holes of manifold 310 in a length direction of primary housing section 120 toward engine housing 142. Accordingly, threaded portions of primary housing attachment members 318 are connected into flange mounting tabs molded at an interior of primary housing section 120 to securely fasten and restrain manifold 310 to primary housing section 120 along the length direction of primary housing section 120.

Cavity housing 114 is molded as an integral portion of primary housing section 120 to form an upper chamber 118*a* for receiving and containing regulated gas flow output from the output side of manifold 310. Manifold 310 includes an output flange 309 positioned within cavity housing 114. A seal 314 is disposed between an end surface 116 of cavity housing 114 and manifold 310. A tube recess 342*b* is formed in manifold 310 for receiving an inlet end of flow tube 340 and a seal mounted on the end of tube 340. A lower recess 118*b* is formed within cavity housing 114 for receiving the opposite outlet end of flow tube 340 along with a seal ring 342*a* positioned in a groove formed on flow tube 340 to ensure a sealed connection. A connection port 118*c* extends through cavity housing 114 from lower recess 118*b* to direct the unregulated gas toward the trigger valve module system 500. Therefore, insertion of the distal or outlet end of flow tube 340 into manifold 310 seals upper chamber 118*a* from unregulated gas flow within flow tube 340. In addition, lower output port 118*c* is axially offset from an outlet 342*c* and interconnected via an outlet cavity 118*d*. Correspondingly, cavity housing 114 includes an upper outlet 118*e* associated with upper cavity chamber 118*a*. As a result, regulated gas flow is provided through upper outlet 118*e* to trigger valve module system 500 and unregulated gas flow directly from cartridges C1 and C2 is provided through lower outlet 118*c* to trigger valve module system 500.

Referring to FIGS. 8A-8E, an upper flow passage 311*a* extends from upper lance assembly 330*a* and a lower flow passage 311*b* extends from lower lance assembly 330*b*.

Lower flow passage 311*b* also includes a regulator assembly input port 322 for directing flow to regulator assembly 400 and an input port 324 for directing unregulated gas flow into flow tube 340.

Figure 8A:
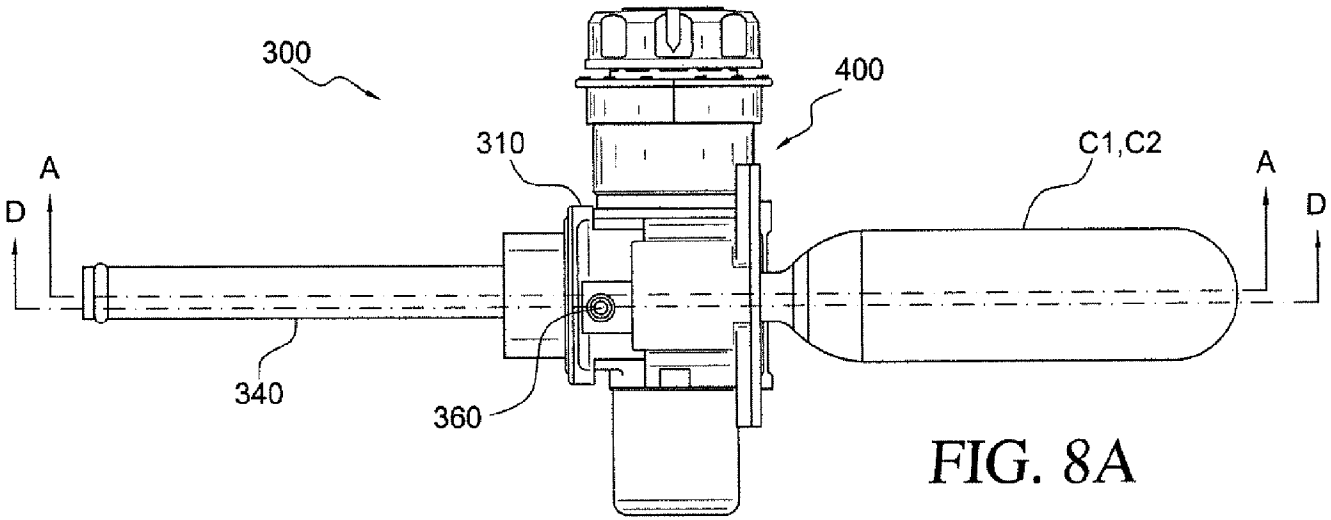
FIGS. 8A-8G are various sectional views of an exemplary gas management system according to the present invention.
Figure 8B:
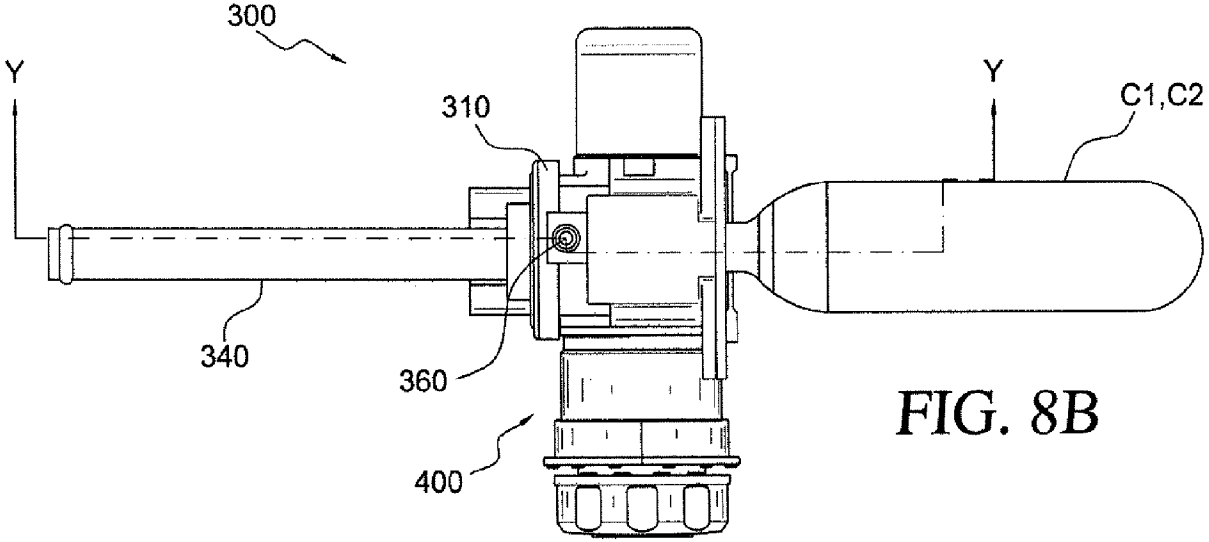
Figure 8C:
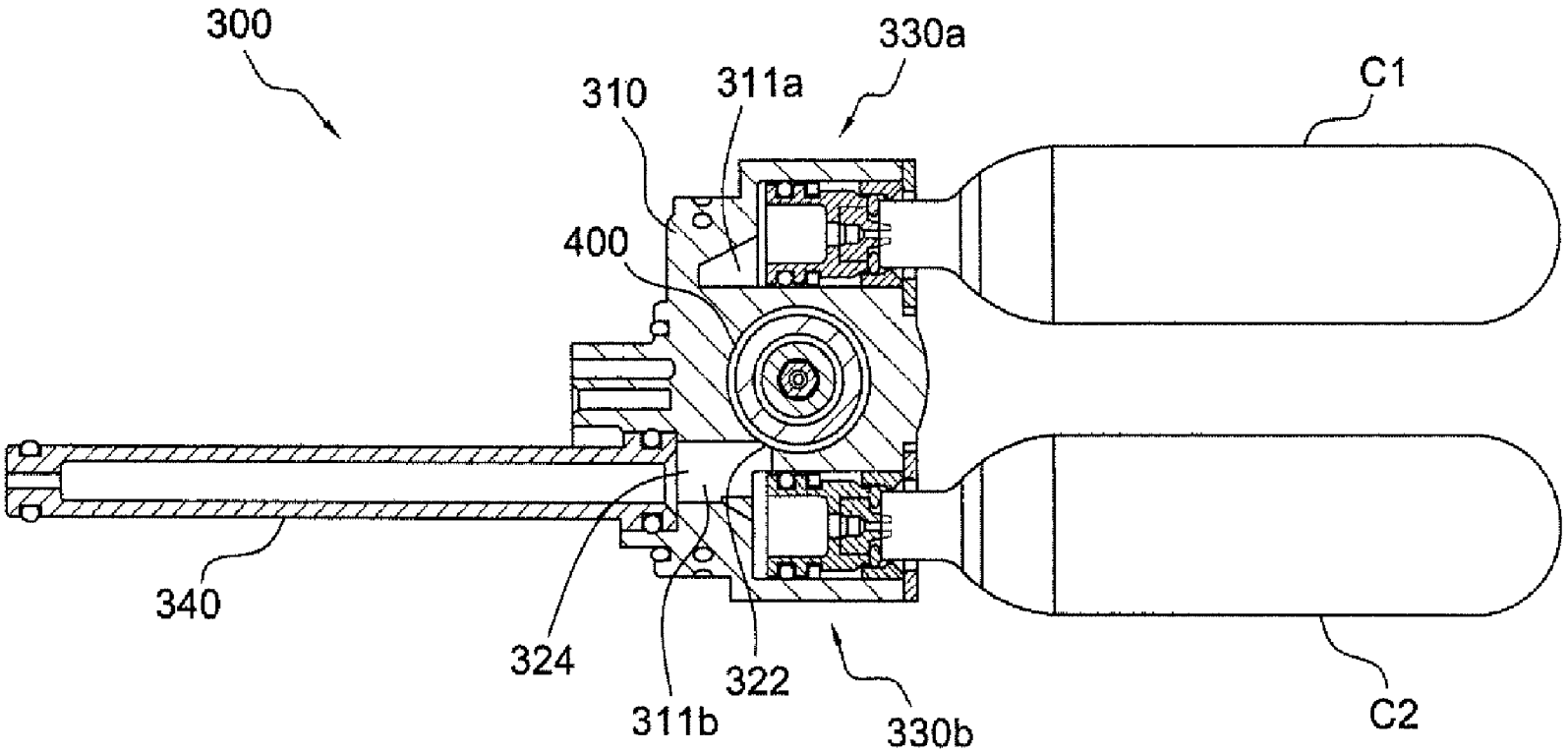
Figure 8D:
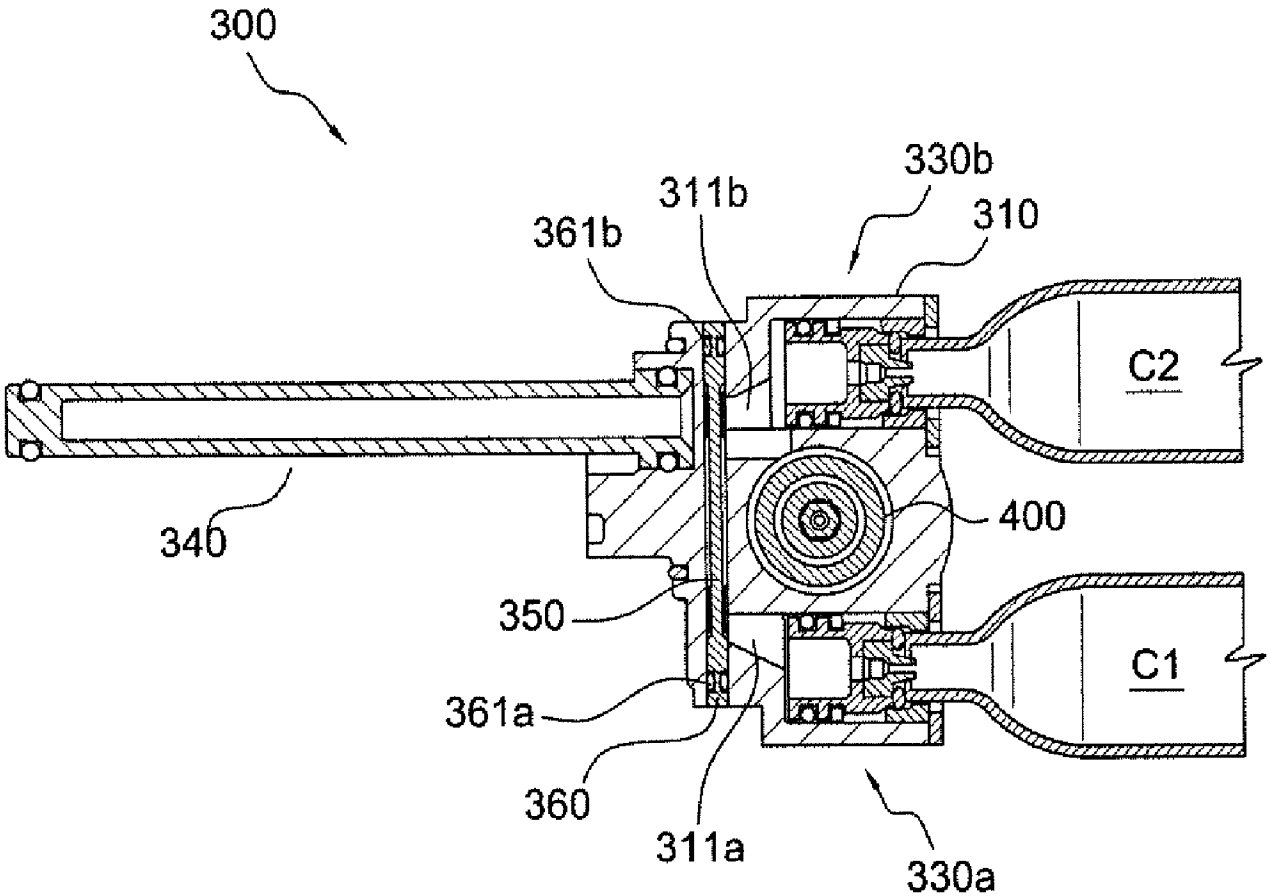
Figure 8E:
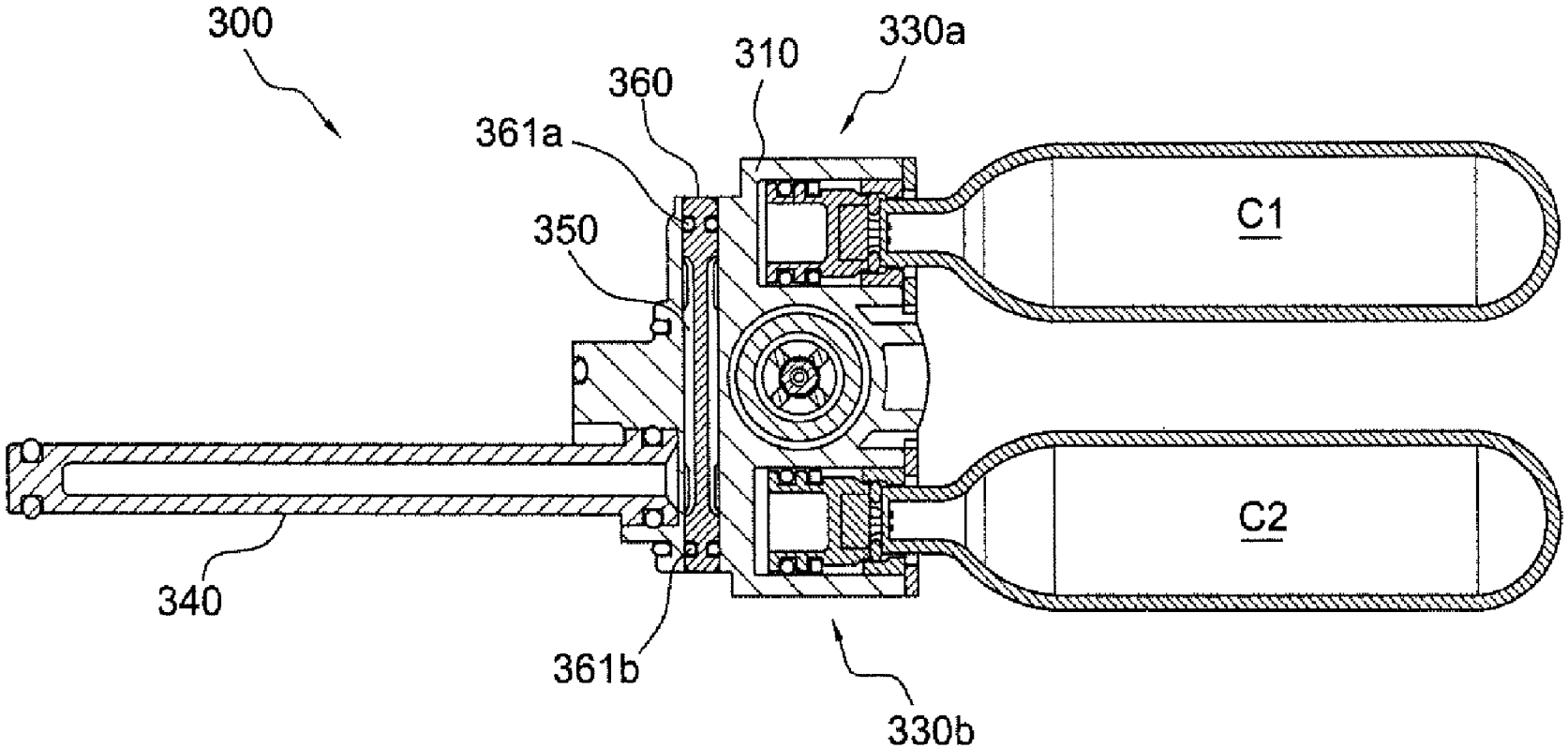

Referring to FIGS. 8A, 8B, 8D, and 8E, manifold 310 includes a cross passage 350 extending through manifold 310 to connect upper and lower lance assemblies 330*a* and 330*b* via upper and lower flow passages 311*a* and 311*b*. A plug member 360 is disposed in cross passage 350 to seal the outer ends of passage 350 using 361*a* and 361*b* mounted on plug member 360. In the preferred embodiment, plug member 360 includes radial splines extending in an axial direction of plug member 360 within cross passage 350 providing channels for compressed gas from cartridges C1 and C2 to flow along cross passage 350. In addition, end portions of the radial splines corresponding to distal end portions of plug member 360 include recesses to allow common interconnection of compressed gas flowing within cross passage 350. Accordingly, plug member 360 provides flow of compressed gas between each of upper and lower flow passages 311*a* and 311*b*, regulator assembly input 322, and input 324 of flow tube 340 as shown in FIG. 8C.

Figure 8F:
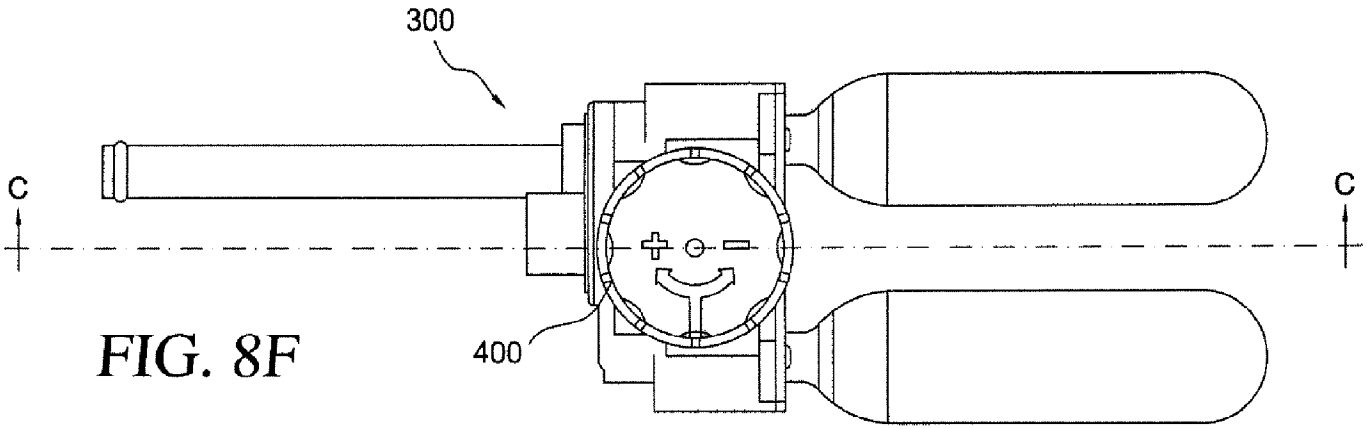
Figure 8G:
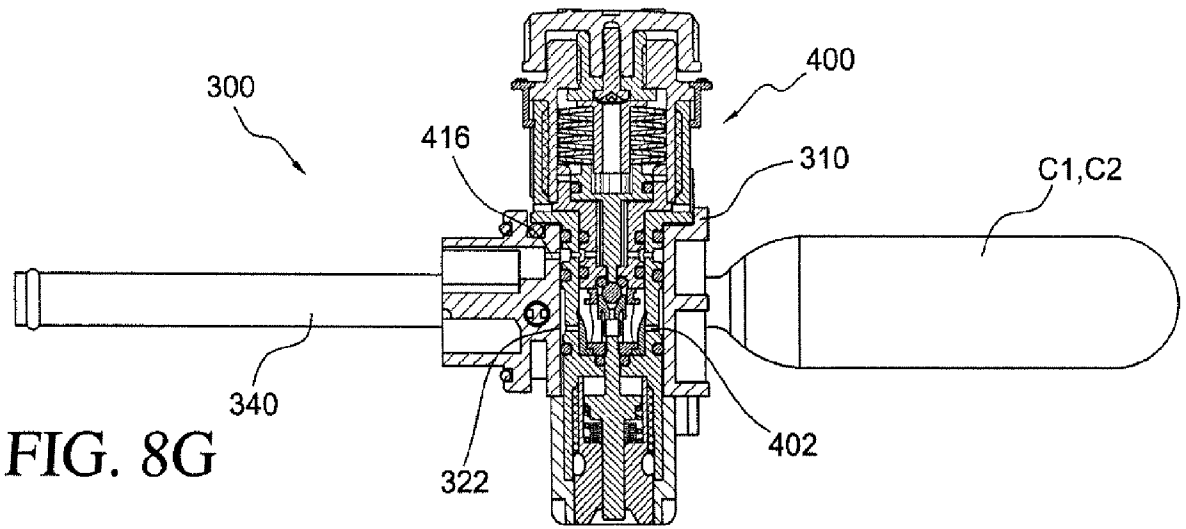

Referring to FIGS. 8F and 8G, gas flows between the input side of manifold 310 to the output side of manifold 310 through regulator assembly 400. Input port 322 connects with a regulator assembly input 402 to direct the gas into the regulator assembly 400. Regulated gas flows out of the regulator assembly 400 through a regulator assembly output 416 formed in manifold 310 and into cavity housing 114 (FIG. 6B). Thus, as shown in FIGS. 8A to 8G, compressed gas flows through manifold 310 from first and second lance assemblies 330*a* and 330*b* and into flow tube 340 as unregulated gas flow, into regulator assembly 400 and out of manifold 310 as a regulated gas flow. Accordingly, the gas management system 300 provides for two different types of compressed gas flows, i.e., regulated and unregulated, supplied at different pressure levels.

Figure 18A:
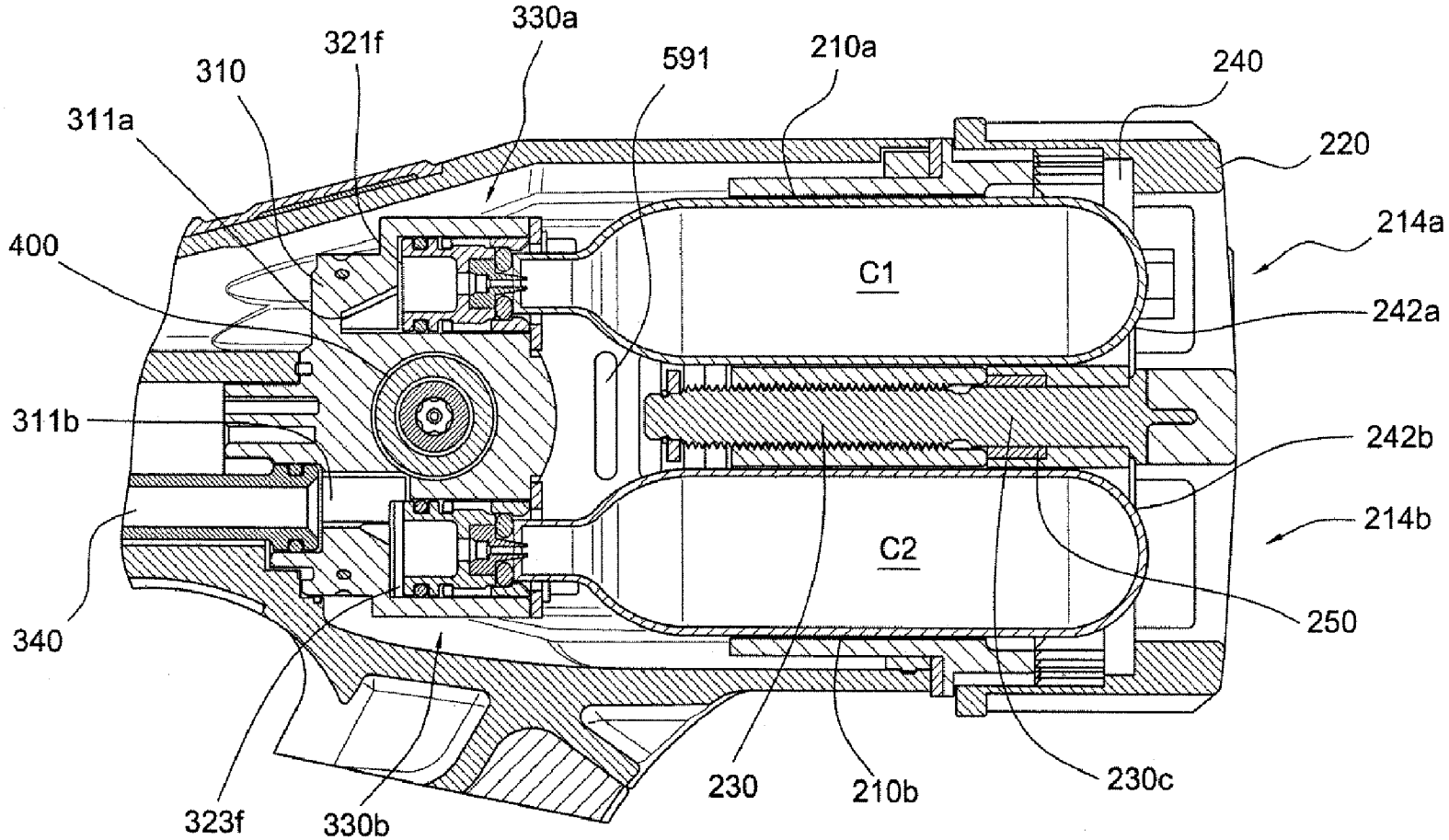
FIGS. 18A and 18B are sectional views of the exemplary source supply system and cartridge containment system according to the present invention.
Figure 18B:
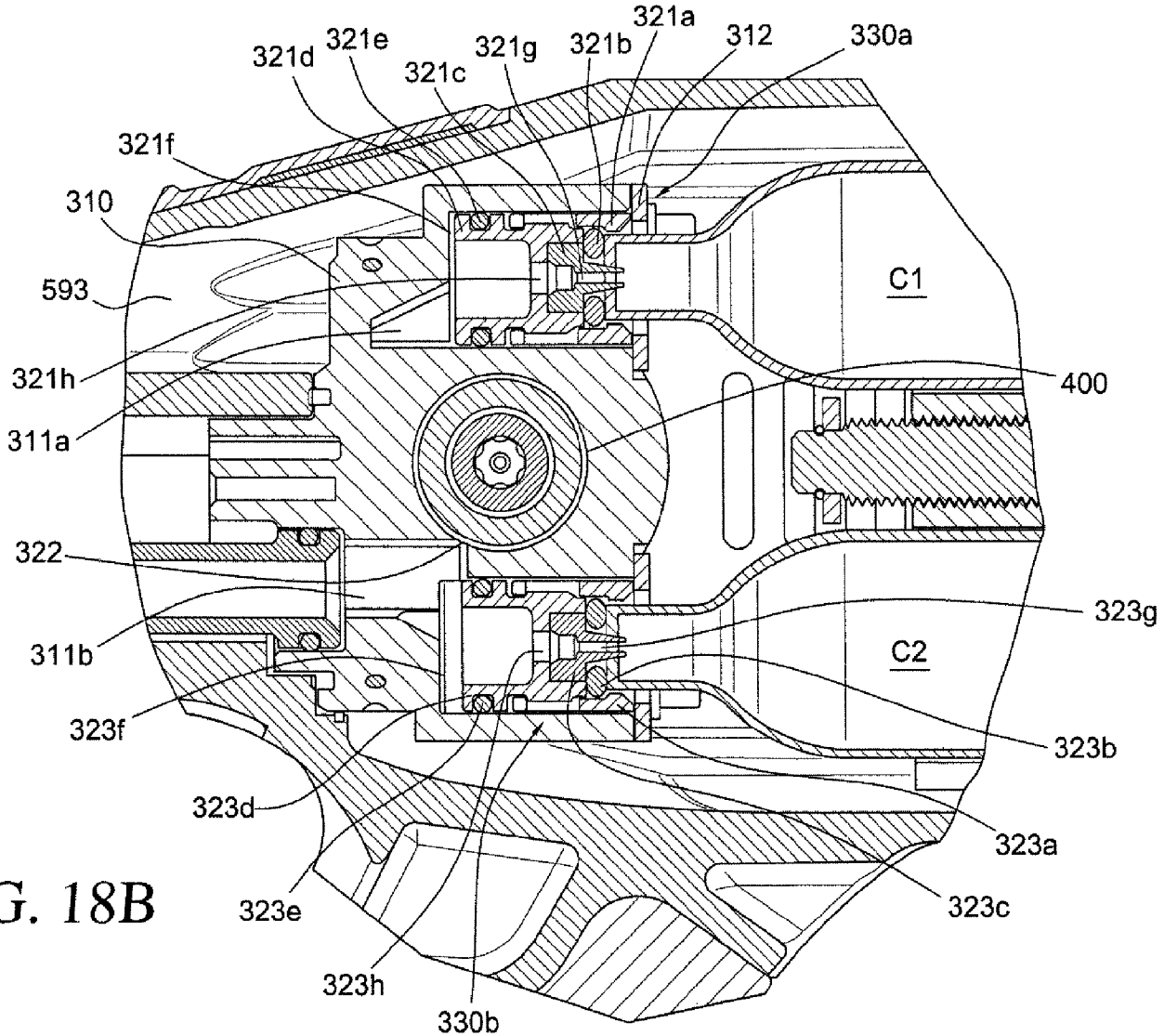

Referring to FIGS. 18A and 18B, gas management system 300 is disposed within primary housing section 120 (FIG. 1), and includes upper and lower lance assemblies 330*a* and 330*b* disposed within manifold 310 along opposite sides of regulator assembly 400. Upper lance assembly 330*a* includes inner and outer lance housings 321*d* and 321*a* disposed within upper manifold recess 321*f*, and a lance 321*c* fixed at an interior of inner lance housing 321*a* and having a bore hole 321*g* aligned with a bore hole 321*h* of inner lance housing 321*d*. Inner lance housing 321*d* includes a seal ring 321*e* provided along an outer circumference thereof to be sealed within upper manifold recess 321*f*. Another seal ring 321*b* is concentrically disposed about an extending portion of lance 321*c*.

Similarly, lower lance assembly 330*b* includes inner and outer lance housings 323*d* and 323*a* disposed within lower manifold recess 323*f*, and lance 323*c* fixed at an interior of inner lance housing 323*d* and having a bore hole 323*g* aligned with a bore hole 323*h* of inner lance housing 323*d*. Inner lance housing 323*d* includes a seal ring 323*e* provided along an outer circumference thereof to be sealed within upper manifold recess 323*f*. Another seal ring 323*b* is concentrically disposed about an extending portion of lance 323*c*.

Manifold plate 312 retains upper and lower lance assemblies 330*a* and 330*b* within upper manifold recesses 321*f* and 323*f*, respectively. However, although upper lance assembly 330*a* is sized relative to upper manifold recess 321*f* so as to permit little or no axial movement of upper lance assembly as cartridge C1 is forced against lance 321*c*, lower lance assembly 330*b* is mounted for axial movement in lower manifold recess 323*f*. Specifically, lower manifold recess 323*f* is longer than lower lance assembly 330*b* thereby permitting lance assembly 330*b* to move back and forth in recess 323*f* as discussed below to advantageously provide enhanced loading and piercing of the cartridges. Of course, in an alternative design, a lower lance assembly may be fixed (not movable) while an upper lance assembly is floating (movable).

Referring to FIGS. 18A and 18B, as well as with reference to FIGS. 7A and 7B, upper and lower compressed gas cartridges C1 and C2 are inserted through openings 214*a* and 214*b* of containment knob 220 and into upper and lower bores 210*a* and 210*b*, respectively, of the cartridge housing member 204. Next, containment knob 220 is rotated along a clockwise direction, and containment plate 240 is rotated from an open position to a closed position.

The loading position includes alignment of seating holes 242*a* and 242*b* of containment plate 240 along a horizontal direction and alignment of openings 214*a* and 214*b* of the containment knob 220 along a vertical direction. Upon initial rotation of containment knob 220, containment plate 240 rotates from the open position to the closed position due to frictional fitting member 250 coupled to middle portion 230*c* of threaded feed fastener 230. Containment plate 240 will stop rotating upon contact of outer edge portions of containment plate 240 with upper containment plate locator members 260*a*. Thus, seating holes 242*a* and 242*b* of containment plate 240 align with arcuate end portions of upper and lower cartridges C1 and C2.

Next upon further clockwise rotation of containment knob 220, containment knob 220 will advance toward upper and lower cartridges C1 and C2. Accordingly, arcuate end portions of upper and lower cartridges C1 and C2 will now engage seating holes 242*a* and 242*b* of containment plate 240. As clockwise rotation of containment knob 220 is continued, containment plate 240 will simultaneously move upper and lower cartridges C1 and C2 into upper and lower bores 210*a* and 210*b* toward upper and lower lance assemblies 330*a* and 330*b* of gas management system 300. As containment plate 240 advances upper cartridge C1 toward upper lance assembly 330*a*, a necked end portion of upper cartridge C1 is received within outer lance housing portion 321*a* and pressed against seal ring 321*b*. Advancement of upper cartridge C1 continues until lance 321*c* pierces a sealed face of upper cartridge C1 and outer circumference regions of the sealed face seat against seal ring 312*b*. However, when lower cartridge C2 is loaded, either the cartridge contacts lower lance assembly 330*b* and the axial force applied by lower cartridge C2 against lower assembly 330*b* moves assembly 330*b* into the longer lower manifold recess 323*f* without piercing lower cartridge C2, or lower lance assembly is retracted in recess 323*f* so as to avoid contact by cartridge C2.

With reference to FIGS. 8C, 18A and 18B, once sealed face of upper cartridge C1 is pierced by lance 321 and seated against seal ring 312*b*, compressed gas flows through upper flow passage 311*a* of manifold 310 and into regulator assembly 400, into flow tube 340, and into lower flow passage 311*b* of manifold 310. Accordingly, compressed gas flows into lower lance bore 321*f* of lower lance assembly 330*b*. Prior to compressed gas flowing into lower flow passage 311*b*, a necked end portion of lower compressed gas cartridge C2 extends into recess 323*f*. However, the sealed face of lower compressed gas cartridge C2 is either spaced apart from lower lance 323*c* by a gap due to the longer recess 323*f* or the cartridge pushes lower lance assembly axially in recess 323*f* without piercing the cartridge. Since lower lance assembly 320*b* is slideably retained within lower lance bore 321*f*, inner and outer lance housings 323*d* and 323*a* are advanced toward sealed face of lower cartridge C2 due to gas pressure force acting on lower lance assembly 330*b* due to compressed gas flow from pierced upper cartridge C1 into lower flow passage 311*b*. Accordingly, the seal ring 323*b* is pressed against the sealed face of lower gas cartridge C2. This movement causes lower lance 323*c* to pierce the sealed face of lower cartridge C2, and compressed gas from within lower cartridge C2 is released into manifold 310 through lower flow passage 311*b*. Thus, compressed gas discharged from lower cartridge C2 creates an axial force causing inner and outer lance housings 323*d* and 323*a* to move against the cartridges. Similar to upper cartridge C1, compressed gas flows through lower flow passage 311*b* of manifold 310 and into regulator assembly 400 and flow tube 340. At this point, gas management system 300 may be considered charged by compressed gas from cartridges C1 and C2.

Thus, by using the floating lance assembly design, cartridge containment system 200 advantageously minimizes the force required to move and pierce cartridges C1 and C2. As a result, the rotational force and effort required by the user to rotate containment knob 220 sufficiently to cause piercing of both cartridges C1 and C2 is reduced, i.e. approximately half the force that would be required to pierce both cartridges using two fixed lance assemblies.

Although the present invention is disclosed as operating with upper and lower cartridges C1 and C2 loaded within gas management system 300, a single cartridge may be operably loaded into the fixed lance assembly while leaving the floating lance assembly empty/unloaded. Although not specifically shown in FIGS. 8C, 18A, and 18B, a check valve may be provided with lower lance assembly 320*b* to prevent discharge of compressed gas flow from, in the present embodiment, upper cartridge C1 into lower flow passage 311*b* and out through cartridge housing member 204 and containment knob 220.

As will be discussed above and further detailed below, once upper and lower cartridges C1 and C2 are no longer able to provide an acceptable operational gas pressure, the used upper and lower cartridges may be removed from gas management system 300. Specifically, containment knob 220 may be rotated along the counter-clockwise direction, thereby withdrawing containment plate 240 away from the arcuate end portions of upper and lower cartridges C1 and C2. containment knob 220 will align openings 214*a* and 214*b* of containment knob 220 with upper and lower bores 210*a* and 210*b*, respectively, of cartridge housing member 204.

Figure 10:
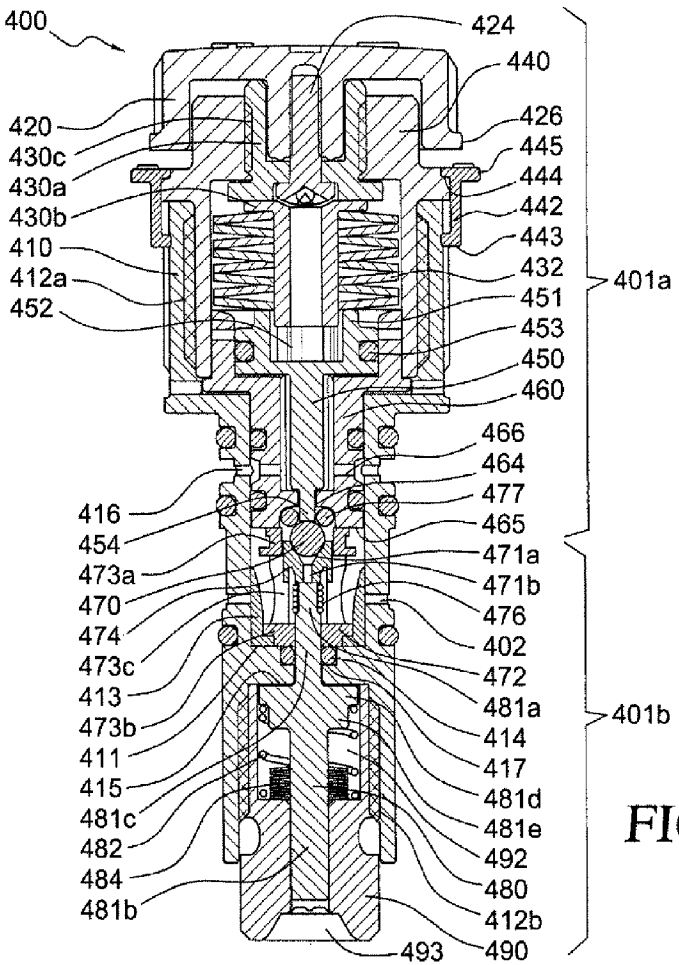
FIG. 10 is a cross-sectional view along A-A of FIG. 9 according to the present invention.
Figure 9:
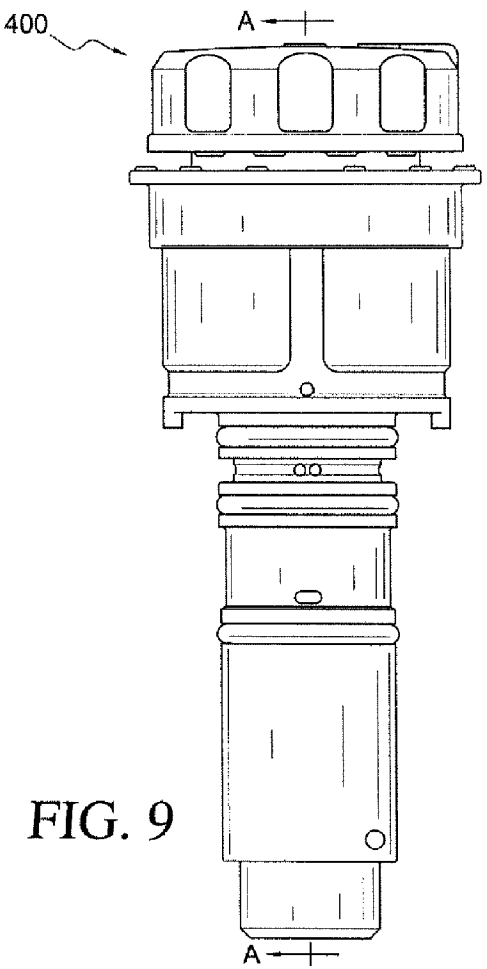
FIG. 9 is a side view of an exemplary regulator assembly according to the present invention.

Referring to FIGS. 9 and 10, regulator assembly 400 generally includes a regulator body having a first portion 401*a* including a regulator valve for gas pressure control and regulation, and a second portion 401*b* having both a fuel indicator for gas pressure indication and an over-pressure protection valve. First portion 401*a* includes a valve body 410, an adjustment knob 420 positioned at a first end portion of valve body 410, a first adjuster 430*a* connected to adjustment knob 420 by a fastener 424, a second adjuster 430*b* biased against first adjuster 430*a* by a biasing spring 432, and an annular retention cap 440 having a first portion extending into adjustment knob 420 and engaging an external first adjuster recess 430*c*, and having one or more second portions extending into first internal valve body recesses 412*a*.

Regulator assembly 400 extends transversely through primary housing section 120 and through a bore formed in manifold 310 so that adjustment knob 420 is positioned on one side of device body 110 while fuel indicator 480/cap 490 is positioned on the opposite side of device body 110. Regulator assembly 400 and the associated bore formed in manifold 310 extend through the centerline of primary housing section 120 and extend between upper and lower lance assemblies 330*a* and 330*b*.

The regulator valve of regulator assembly 400 includes a piston 450 operably positioned with respect to first and second adjusters 430*a* and 430*b*, a sleeve 460 between piston 450 and valve body 410, and a ball 470 controllably positioned by piston 450. Second portion 401*b* of regulator assembly 400 includes a fuel indicator 480 positioned at a second end portion of valve body 410 and slideably received within a cap 490 which extends into a recess 412*b* in valve body 410 to fixedly attach cap 490 to body 410.

Although not shown, retention cap 440 includes a detent to prevent adjustment knob 420 from inadvertently rotating to change the selected regulated gas pressure output of regulator assembly 400. In addition, retention cap 440 is coupled to valve body 410 by an annular keeper 442 having a first end portion 443 inserted into an annular groove in valve body 410 and a second end portion 444 inserted into an annular groove of retention cap 440. Annular keeper 442 further includes a flange portion 445 protruding past an annular flange 426 of adjustment knob 420. Flange portion 445 may include pressure markings for the user to select a desired operating pressure.

In FIG. 10, biasing spring 432 is compressively disposed between second adjuster 430*b* and a piston end face 451, wherein second adjuster 430*b* extends into a cylindrical piston recess 452. Biasing spring 432 is preferably a Belleville washer/spring. Piston 450 includes a seal ring 453 engaging inner sidewalls of sleeve 460. Accordingly, rotation of adjustment knob 420 adjusts the compression of biasing spring 432.

Regulator assembly 400 further includes a ball guide 472, a ball plunger 474, and a plunger spring 476 to normally bias ball 470 against seal ring 477. Ball guide 472 includes a first flange 473*a* seated against a sleeve end portion 465 and a second flange 473*b* pressed against an inner valve body sidewall 411. First and second flanges 473*a* and 473*b* are interconnected by standoffs 473*c* to house ball plunger 474 and plunger spring 476. In addition, check seal 413 is provided adjacent to second flange 473*b* to only allow gas entry through regulator assembly supply ports 402 and block gas flow back out through regulator assembly supply ports 402.

Plunger spring 476 biases ball plunger 474 to press a spherical outer surface of ball 470 into a seated position against conical ball plunger surface 471*a* and seal ring 477 forming an annular seal. In addition, a piston end portion 454 is aligned with a sleeve orifice 464 and centered with an interior of seal ring 477. Accordingly, the relative positioning of the spherical surface of ball 470 with respect to seal ring 477 is determined by the position of piston end portion 454, which is initially determined by the compression of biasing spring 432. Gas flow through a gap between ball 470 and seal ring 477 is regulated by rotating adjustment knob 420 to set the spring force or preload on piston 450. Gas pressure applies a force against piston 450 to move piston 450 against spring 432. The greater the set spring force against piston 450, the greater the resistance the piston 450 has to the gas pressure forces acting on the piston 450. Thus the greater the resistance of spring 432, the greater the gas pressure required to open the regulator. Thus, rotation of adjustment knob 420 adjusts the set pressure of regulator system 400.

Fuel indicator 480 has a first end portion 481*a* disposed adjacent to ball plunger 474 within plunger spring 476, a second end portion 481*b* extending into cap 490, and a central portion 481*c* disposed within a body orifice of valve body 410. A seal ring 414 is disposed in a recess of valve body 410 providing a sealing surface with central portion 481*c*. In addition, fuel indicator 480 includes a first diameter portion 481*d* biased against a valve body wall portion 415 by an indicator spring 482 housed within a cap space 492, and a second diameter portion 481*e* disposed within indicator spring 482. Moreover, a spring 484, i.e. a Belleville washer stack, is provided concentrically along second end portion 481*b* within indicator spring 482, as explained in detail below.

Figure 12:
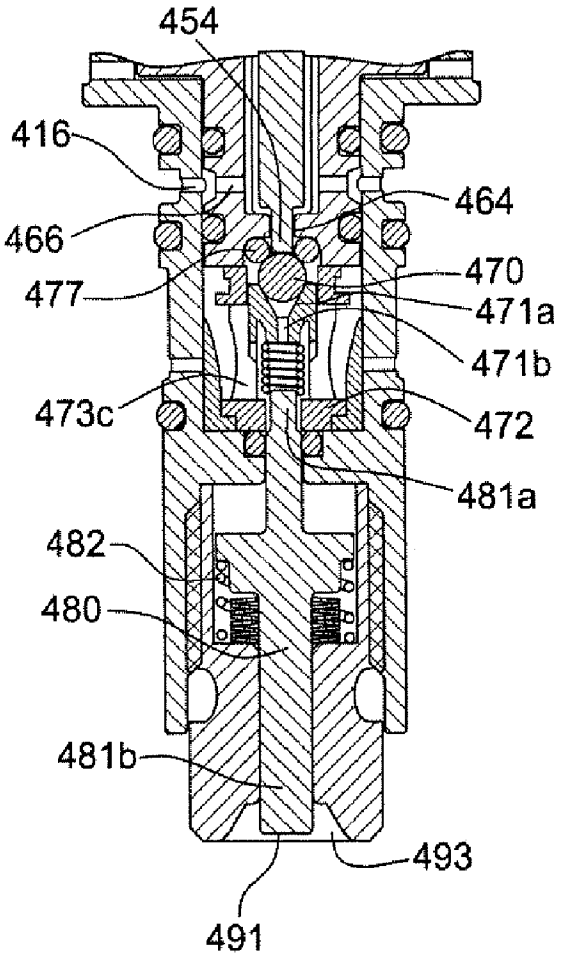
FIG. 12 is a second enlarged sectional view of the regulator assembly of FIG. 10 according to the present invention.
Figure 11:
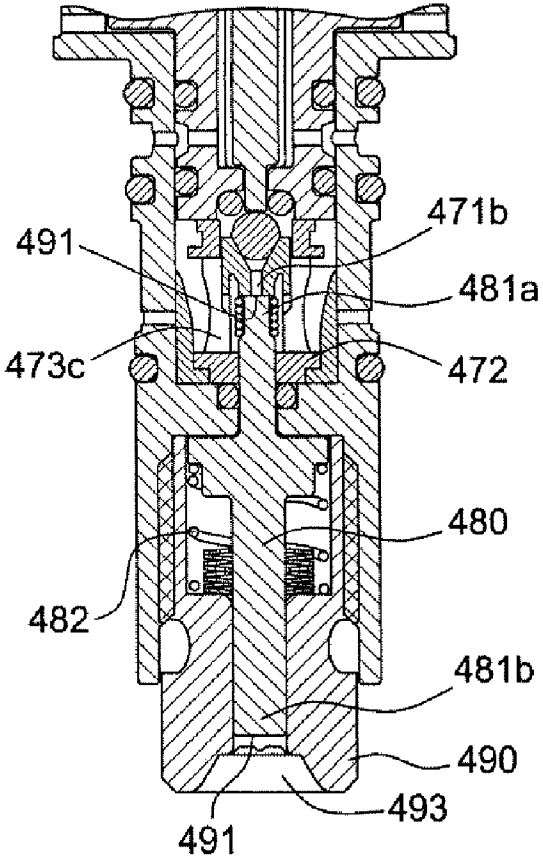
FIG. 11 is a first enlarged sectional view of the regulator assembly of FIG. 10 according to the present invention.

Regulator assembly 400 functions to provide for gas pressure regulation, gas pressure indication, and over-pressurization protection in one integrated assembly creating a compact module. During gas pressure regulation, compressed gas from cartridges C1 and C2 flows through manifold 310, as detailed above, and into regulator assembly supply ports 402. Then, as shown in FIG. 11, compressed gas flows into ball guide 472 between standoffs 473*c*. If the force of compressed gas from cartridges C1 and C2 acting upon first end portion 481*a* of fuel indicator 480 is slightly greater than a spring force of indicator spring 482, then fuel indicator 480 will be moved away from ball guide 472 and indicator spring 482 will be compressed. until fuel indicator 480 contacts spring 484. Accordingly, end surface 491 of second end portion 481*b* will be displaced outwardly through a central cap opening 493 into a first extended position, and be visible to a user to indicate that gas, at pressure sufficient for operation, is flowing from at least one of the cartridges C1, C2, as shown in FIG. 12. The user will notice not only the extended position of fuel indicator 480 but also the sides of second end portion 481*b* are preferably covered with a colored material having high visibility to the user to differentiate the retracted position from the extending position.

Figure 13:
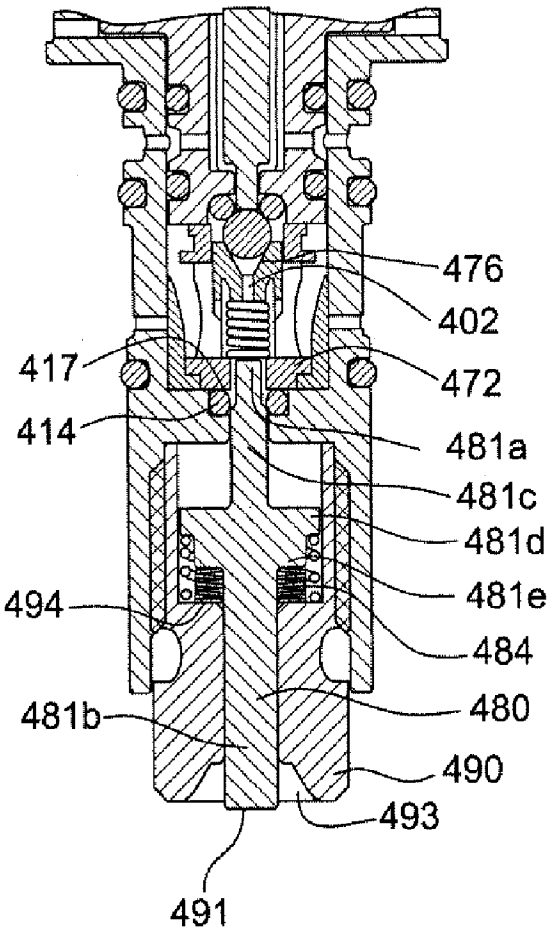
FIG. 13 is a third enlarged sectional view of the regulator assembly of FIG. 10 according to the present invention.

Referring to FIGS. 10-13, compressed gas within ball guide 472 will flow through ball plunger bore 471*b* and conical ball plunger surface 471*a* and be applied to spherical surface of ball 470 disposed adjacent to conical ball plunger surface 471*a*. As discussed previously, the gas pressure acts on piston 450 to move piston 450 relative to ball 470 thereby determining the output pressure of the regulator. The preload force of spring 432, which can be adjusted by rotating adjustment knob 420, determines the equilibrium output pressure from the regulator by setting the downward force on piston 450 which determines the upward force (determined primarily by gas pressure) required to displace piston 450 and spring 432. Next, compressed gas flows through one or more sleeve outlets 466, through one or more valve body outlets 416, and through manifold 310 (FIGS. 8A-8G) via regulator assembly output ports 404 as regulated gas flow. It should be noted that the distance between ball 470 and seal ring 477 is very small and thus difficult to illustrate in the accompanying figures. However, FIGS. 10 and 11 show ball 470 in the open position while FIGS. 12 and 13 show ball 470 in the closed position against seal ring 477.

Referring to FIG. 10, although the regulator system 400 may function to provide a pressure regulated gas supply, the regulator system 400 also functions as an indicator for when unregulated compressed gas supply is inadequate for proper operation of the fastener driving device 100 (FIG. 1). Specifically, the regulator system 400 functions to provide a user with a visual indication regarding the operational status of the fastener driving device 100 (in FIG. 1).

Referring to FIG. 11, if the force of unregulated compressed gas from cartridges C1 and C2 acting upon first end portion 481*a* of fuel indicator 480 is equal to or less than a spring force of indicator spring 482, then first end portion 481*a* of fuel indicator 480 will remain positioned adjacent to ball plunger 474 and spaced apart from seal bore 471*b*. Accordingly, an end surface 491 of second end portion 481*b* of fuel indicator 480 will not be displaced into central opening 493 of cap 490, but will remain in a retracted or recessed position so that the sides of end portion 481*b* are not be visible to a user. Thus, the retracted position of fuel indicator 480 will indicate to the user that the fastener driving device 100 (FIGS. 1-4) does not have adequate operable gas pressure.

Moreover, regulator system 400 includes an over-pressure protection valve that functions to automatically prevent over-pressurization within regulator assembly 400 when unregulated compressed gas supply pressure within regulator assembly 400 exceeds a threshold pressure. During over-pressurization, as shown in FIG. 13, the pressure of compressed gas supplied to the regulator input port 402 forces fuel indicator 480 against spring 484 compressing spring 484. Thus, first end portion 481*a* of fuel indicator 480 will be withdrawn from within plunger spring 476, thereby forming a gap 417 between seal ring 477 and first end portion 481*c* of fuel indicator 480 allowing compressed gas within ball guide 472 to pass through gap 417, along second end portion 481*b*, and out to atmosphere via central opening 493 as a compressed gas overflow.

This compressed gas overflow will continue until compressed gas supply pressure within regulator assembly 400 is reduced to a level below threshold pressure. Once below threshold pressure, first end portion 481*a* of fuel indicator 480 will advance back within plunger spring 476, thereby forming closing gap 417 previously formed between seal ring 414 and first end portion 481*c* of fuel indicator 480. Accordingly, compressed gas overflow will cease to flow to atmosphere out through opening 493, and will resume flow through ball guide 472, as detailed above.

Upon occasion when compressed gas pressure significantly exceeds threshold pressure, first diameter portion 481*d* abutting spring 484 will begin to compress spring 484 against an interior wall portion 494 of cap 490. Accordingly, gap 417 will increase to increase the flow of the above-threshold pressure gas.

As initially shown in FIG. 5, the fastener driving device 100 includes an exemplary valve system 500 including a valve module 501 disposed within the primary housing body 110. The valve module 501 is positioned to connect and control flow through passages extending between gas management system 300 and a drive engine 600 to provide control of the drive engine 600, as well as provide various safety functions for the fastener driving device 100.

Figure 14:
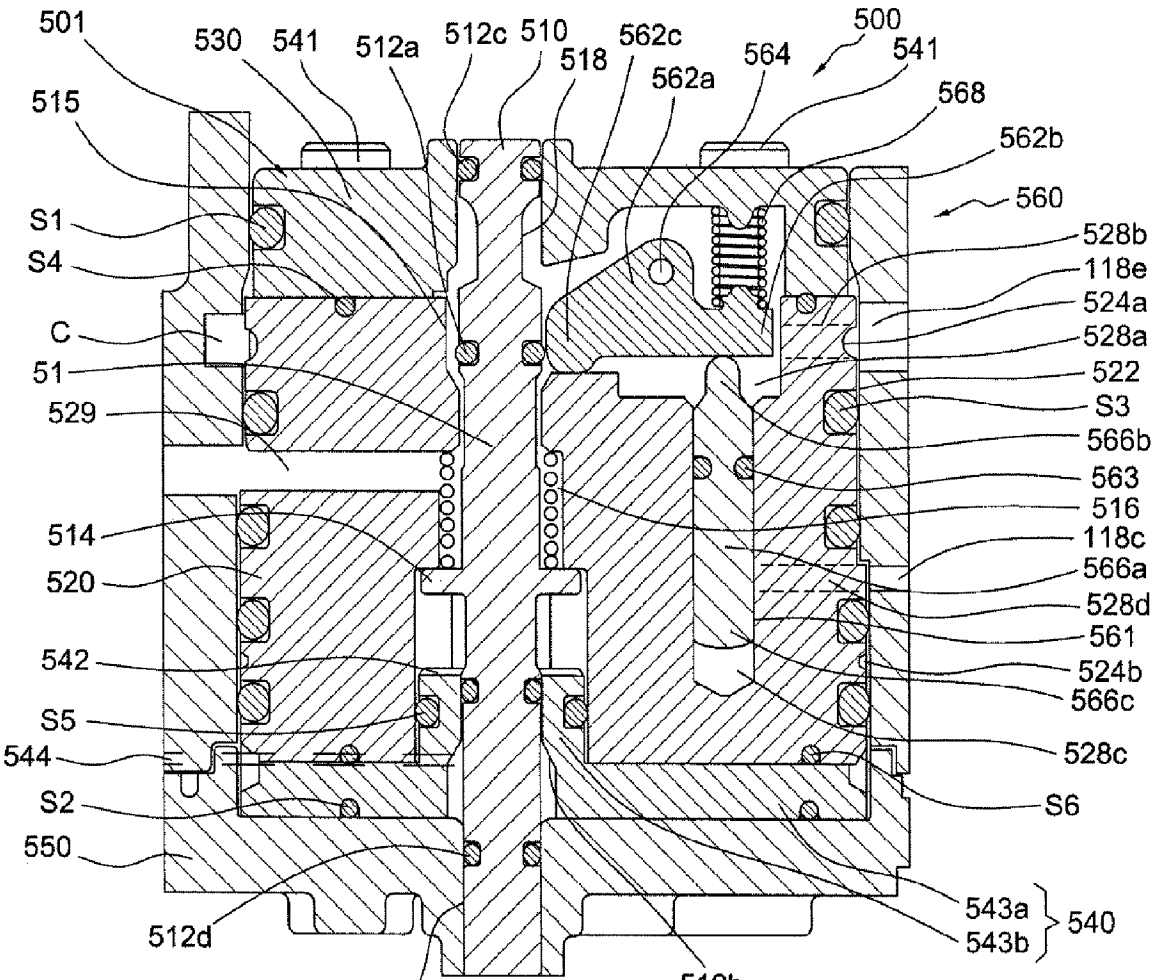
FIG. 14 is a first enlarged sectional view of the exemplary valve module of FIG. 5 according to the present invention.

FIG. 14 is an enlarged sectional view of the valve system 500 of FIG. 5. Valve module 501 generally includes various components including, a valve manifold 520, a manifold cap 530, and a valve cap 540 fastened together by a plurality of fasteners 541. Valve module 501 is disposed within a cavity C of the internal housing structure of primary housing section 120 (FIGS. 1-4). Valve module 501 further includes a bore 515 extending through valve manifold 520, manifold cap 530 and valve cap 540, and a trigger valve stem 510 mounted for reciprocal movement in bore 515, as described herein. The lower side of cavity C is covered by a lower portion 550 of nose assembly housing 146 (FIG. 5) which includes an stem opening 517 aligned with bore 515 to allow trigger valve stem 510 to extend out of nose assembly housing 146 for operation by trigger assembly 148 (FIG. 1).

Trigger valve stem 510 includes a central portion 512 positioned between an upper seal ring 512*a* and a lower seal ring 512*b*. Central portion 512 includes an annular portion 514 biased against an upper region 542 of the valve cap 540 by a valve stem spring 516. In addition, trigger valve stem 510 is continuously sealed within bore 515 and stem opening 517 by an uppermost seal ring 512*c* and a lowermost seal ring 512*d*, respectively. The upper end of trigger valve stem 510 is continuously exposed to either atmospheric pressure or relatively low pressure in exhaust cavity 593 (FIG. 35) while the lower end is exposed to atmospheric pressure. As a result, trigger valve stem 510 is substantially pressure balanced thereby minimizing the force required by the user to move the trigger during actuation.

Valve manifold 520 includes a plurality of annular grooves 522 each retaining a seal ring S3 to seal valve module 501 within cavity C of primary housing 110 (FIGS. 1-4). Also, a seal ring S1 is mounted on manifold cap 530 to seal the upper end of valve module 501 in cavity C. In addition, trigger valve manifold 520 includes an upper annular passage 524*a* positioned opposite upper outlet port 118*e* and a lower annular passage 524*b* connected to atmosphere via one or more passages (not shown). Accordingly, regulated output from the output side of manifold 310 (FIG. 6B) is provided around an exterior of valve manifold 520. A first interior volume 528*a* is formed in valve manifold 520 and manifold cap 530. A passage 528*b* extends through manifold 520 to connect output port 118*e* to volume 528*a* to supply regulated gas flow to volume 528*a*. Moreover, unregulated gas flow through flow tube 340 (FIGS. 8A-8G) is provided around an exterior of valve manifold 520, as well as into a second interior volume 528*c* of valve manifold 520 via a passage 528*d* formed in valve manifold 520.

Figure 15B:
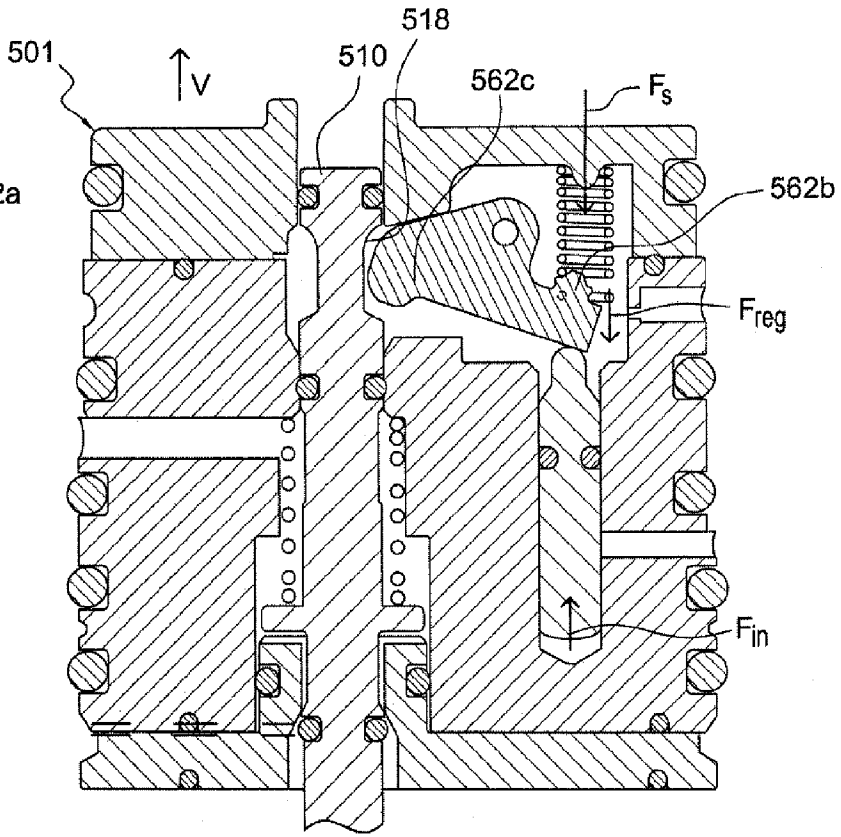
FIGS. 15A and 15B are second and third enlarged sectional views of the exemplary valve module of FIG. 5 according to the present invention.
Figure 15A:
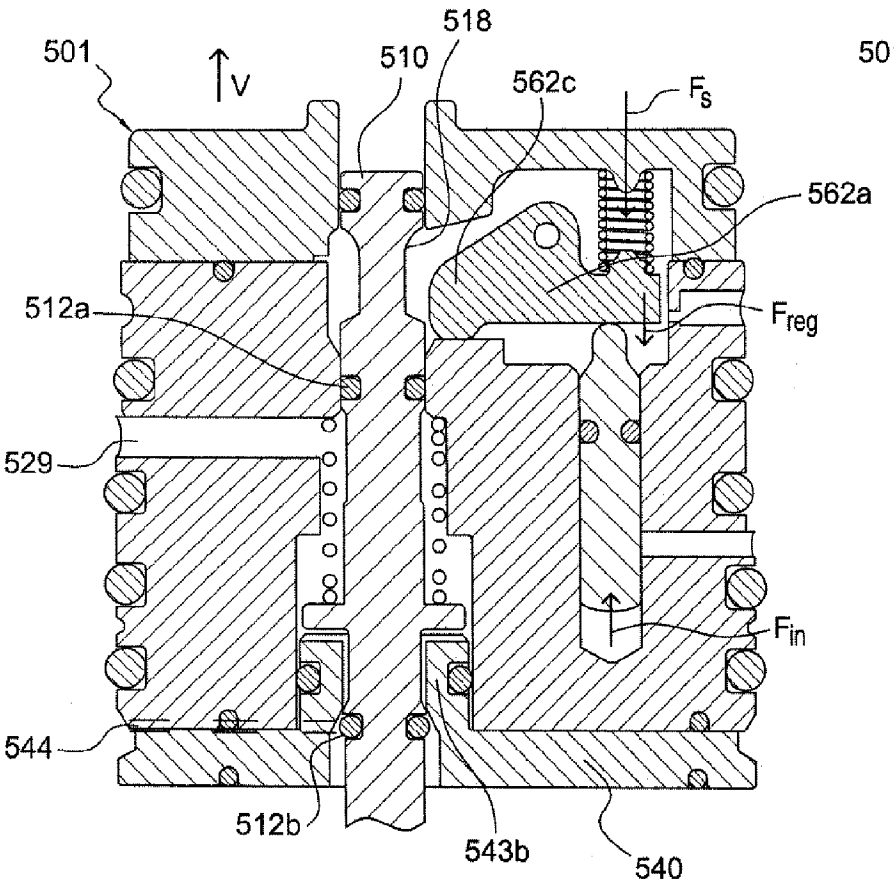

In FIGS. 14, 15A and 15B, manifold cap 530 is sealed together with valve manifold 520 by a seal ring S4 to house a low pressure lock-out system 560 at least partially positioned in first interior volume 528*a*. Low pressure lock-out system 560 includes a lock-out pawl 562*a* pivotally mounted on a pivot pin 564, and a lock-out pawl plunger 566*a* and associated seal 563 positioned in a bore 561 to separate first interior volume 528*a* and second interior volume 528*c*. Vertical movement of lock-out pawl plunger 566*a* is determined by differential pressures between first and second interior volumes 528*a* and 528*c*. Specifically, a first end portion 562*b* of lock-out pawl 562*a* is biased against an upper end portion 566*b* of lock-out pawl plunger 566*a* by a spring force $F_S$ of a lock-out pawl spring 568. Similarly, upper end portion 566*b* of lock-out pawl plunger 566*a* is biased against first end portion 562*b* of lock-out pawl 562*a* due to an unregulated gas pressure force $F_{in}$ corresponding to unregulated gas flow pressure in second interior volume 528*c* that acts upon lower end portion 566*c* of lock-out pawl plunger 566*a*. Moreover, lock-out pawl plunger 566*a* is subject to a regulated output flow force $F_{reg}$ corresponding to regulated output flow from manifold 310 (FIG. 6B) into first interior volume 528*a* that acts upon upper end portion 566*b* of lock-out pawl plunger 566*a*. By preventing movement of trigger valve stem 510, a user can not actuate trigger valve stem 510 when trying to actuate the device by applying force to trigger 148 in low source pressure situations. Since fasteners can be insufficiently driven into a work piece due to insufficient pressure, this feature is useful for preventing nails from being partially driven into a workpiece, and reducing waste of fasteners while improving work production and efficiency.

Low pressure lock out system 560 also functions as a safety feature to ensure that trigger 148 can not be operated once cartridges are removed from cartridge containment system 200. When the cartridges are removed, pressurized gas may still be present in the various chambers of the device. Without lock-out pawl system 560, this volume of pressurized gas may be sufficient to permit several actuations of the device resulting in the driving of numerous fasteners. A user noticing that no cartridges may expect the device to be inoperable. Lock out pawl system 560 ensures the device 100 can not be actuated with the cartridges removed thereby ensuring the user does not inadvertently drive a fastener thereby avoiding potential injury.

Referring to FIG. 15A, as represented by equation (1) below, if a summation of spring force $F_S$ and regulated output flow force $F_{reg}$ is less than or equal to unregulated gas flow force $F_{in}$, then, as shown in FIG. 14, lock-out pawl 562*a* will not pivot and second end portion 562*c* of the lock-out pawl 562*a* will not engage necked portion 518 of trigger valve stem 510 thereby allowing upward vertical movement V of trigger valve stem 510.

$$F_S+F_{reg}<F_{in}, \text{ then lock-out disabled} \quad (1)$$

Thus, actuation of trigger valve stem 510 will be enabled, thereby allowing the user to operate fastener driving device 100 (FIGS. 1-4).

Conversely, as shown in FIG. 15B, if, as presented by equation (1) below, a summation of spring force $F_S$ and regulated output flow force $F_{reg}$ is greater than unregulated gas flow force $F_{in}$, then lock-out pawl 562*a* will pivot clockwise and second end portion 562*c* of the lock-out pawl 562*a* will engage necked portion 518 of trigger valve stem 510 to prevent upward vertical movement V of trigger valve stem 510.

$$F_S+F_{reg}>F_{in}, \text{ then lock-out enabled} \quad (1)$$

Thus, actuation of trigger valve stem 510 will be prevented, thereby preventing the user from operating fastener driving device 100 (FIGS. 1-4) under low pressure situations.

In FIG. 14, valve cap 540 includes an upper portion 543*a* disposed within an opening of valve manifold 520, and a lower portion 543*b* disposed between valve manifold 520 and lower portion 550 of nose assembly housing 146 (FIG. 5). Upper and lower portions 543*a* and 543*b* are sealed with valve manifold 520 by seal rings S5 and S6, respectively, while the interface between lower portion 543*b* and nose assembly housing 146 is sealed by seal ring S2.

As will be detailed herein below, valve manifold 520 further includes a gas passage 529 that provides for gas flow, or fluidic connection, between different portions within drive engine 600 (FIG. 5), as well as fluidic connection of different portions of drive engine 600 (FIG. 5) and regulated gas flow output from gas management system 300.

Figure 17:
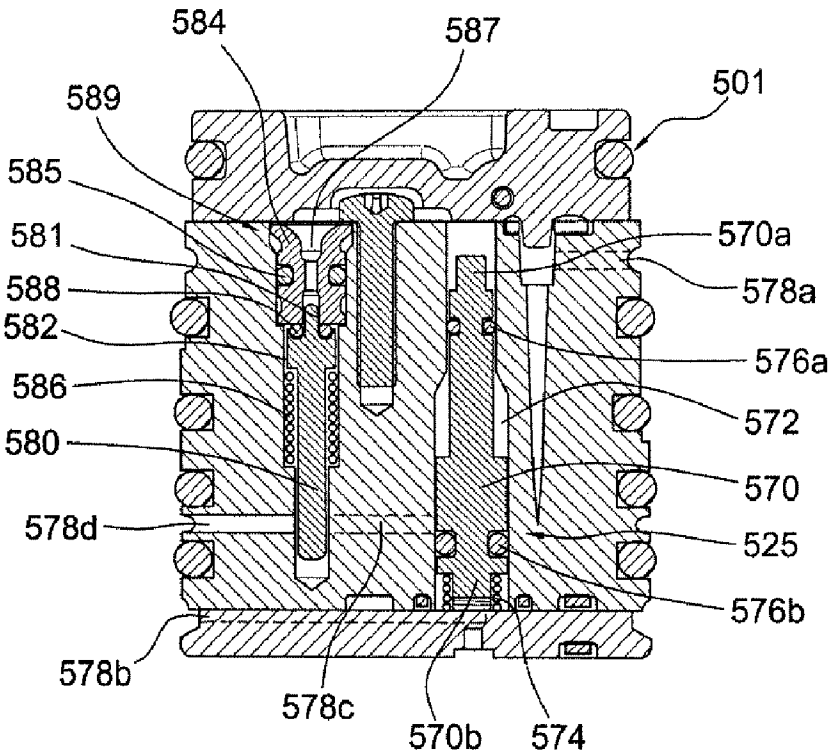
FIG. 17 is cross-sectional views along D-D of FIG. 16 according to the present invention.
Figure 16:
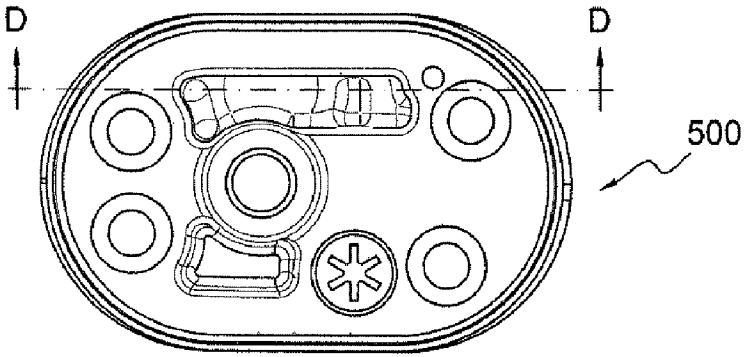
FIG. 16 is a top view of the exemplary valve module of FIG. 5 according to the present invention.

Valve system 500 provides numerous primary functions including device actuation, pressure management, and operational safety. As detailed above with regard to FIGS. 15A and 15B, valve module 501 provides for a low pressure lock-out function using low pressure lock-out system 560. In addition, FIG. 17 demonstrates an exemplary method for pressuring re-balancing between various components of drive engine 600 (FIG. 5), as well as high pressure relief from fastener driving device 100 (FIGS. 1-4). In FIG. 17, valve module 501 includes a pressure rebalancing system 525 comprising a differential spool 570 biased downward within a bore 572 of trigger valve manifold 520 by summation of forces acting on opposing ends 570*a*, 570*b* of differential spool 570 to maintain a sealed region of bore 572 above an upper seal ring 576*a* disposed on an upper spool end portion 570*a*, and below a lower seal ring 576*b* disposed at a lower spool end portion 570*b*. Upper spool end portion 570*a* is subjected to regulated gas pressure $P_{reg}$ via an upper passage 578*a* formed in valve manifold 520. In addition, lower spool end portion 570*b* is subject to an initial gas pressure $P_{in}$ from various regions (i.e. bladder, holding and reservoir gas) provided within drive engine 600 (FIG. 5), which will be detailed below, via a lower passage 578*b* formed in the upper surface of valve cap 540. Furthermore, a middle passage 578*c* is provided in trigger valve manifold 520 and connects to bore 572 between upper and lower spool end portions 570*a* and 570*b*. Middle passage 578*c* provides a vent to atmosphere via a passage 578*d* also formed in valve manifold 520.

In FIG. 17, differential spool 570 maintains a set pressure ratio between regulated gas pressure $P_{reg}$ and initial gas pressure $P_{in}$ from various pressure regions provided within drive engine 600 (FIG. 5) with trigger valve stem 510 (FIG. 15A) at a rest/un-actuated position. For example, when regulated gas pressure $P_{reg}$ and initial gas pressure $P_{in}$ are within the set pressure ratio, middle passage 578*c* is positioned between upper and lower seal rings 576*a* and 576*b*. Accordingly, initial gas pressure $P_{in}$ is maintained within drive engine 600 (FIG. 5). However, when regulated gas pressure $P_{reg}$ and initial gas pressure $P_{in}$ are not within set pressure ratio, differential spool 570 is displaced upward to expose middle passage 578*c*, thereby venting initial gas pressure $P_{in}$ to atmosphere via passage 578*d*. This venting position is maintained until the summation of forces move differential spool 570 back down bore 572. Moreover, once this venting is completed, drive engine 600 (FIG. 5) will undergo an initial gas pressurization to return to initial gas pressure $P_{in}$, as detailed below.

In FIG. 17, valve module 501 includes a high pressure relief system 589 having a high pressure relief spool disposed within a bore 582 extending substantially parallel to bore 572. High pressure relief spool 580 is biased against a high pressure relief orifice housing 584 by a high pressure relief spring 586. Housing 584 includes a central orifice 587 opening at an upper end of valve module 501 receiving regulated gas pressure. In addition, high pressure relief spool 580 includes a seal ring 588 disposed between an upper end portion 581 of high pressure relief spool 580 and a lower surface of high pressure relief orifice housing 584 to block flow through central orifice 587 when in a closed position. A seal ring 585 is mounted on high pressure relief orifice housing 584 to seal against an inner sidewall portion of the bore 582.

When force $F_{reg}$ corresponding to regulated gas pressure $P_{reg}$ acting upon upper end portion 581 of high pressure relief spool 580 exceeds spring force $F_S$ of high pressure relief spring 586, spool 580 moves downwardly causing the seal between seal ring 588 of high pressure relief spool 580 and high pressure relief orifice housing 584 to be broken. Thus, regulated gas flow from within valve module 501 flows around spool 580 downward through bore 582 and is vented to atmosphere via passage 578*d*. This venting position of high pressure relief spool 580 is maintained until force $F_{reg}$ is reduced to below spring force $F_S$ of high pressure relief spring 586.

The primary functions of valve system 500 include providing automatic protection to the user by preventing unsafe accumulation of abnormal gas pressures, as well as an imbalance between the various internal volumes. For example, valve system 500 provides for automatic pressure relief when pressure within device body 100 increases above a maximum limit of allowable regulated pressure due to circumstances unforeseen by the user. If an obstruction, such as debris or water, unknowingly enters into the device body 100 (FIGS. 1-4) and obstructs critical passages within the device body 100 to prevent safe operation of the fastener driving device 100 (in FIGS. 1-4), then valve module 501 would automatically relieve the excess pressure by venting the excess pressure to atmosphere. This atmospheric venting would continue until regulated gas pressure is reduced below the maximum limit, such as clearing of the obstruction. Therefore, the valve system 500 not only provides for operation of the fastener driving device 100, but also provides the user with an automatic system to maintain effective operational safety while using the fastener driving device 100.

As described above, valve system 500 also provides for maintaining pressure balance within the fastener driving device 100 between regulated gas pressure and the pressure of holding, reservoir, and bladder volumes 710, 720, and 730 during and after initial gas pressurization. For example, valve module 501 provides for automatic venting to atmosphere from holding, reservoir, and bladder volumes 710, 720, and 730 when initial gas pressurization of holding, reservoir, and bladder volumes 710, 720, and 730 exceeds an upper limit ratio versus regulated gas pressure. Due to flow characteristics of the fastener driving device 100, if pressures of holding, reservoir, and bladder volumes 710, 720, and 730 are excessively above a certain ratio versus regulated gas pressure, the fastener driving device 100 will not properly function. Accordingly, the valve system 500 provides for maintaining pressure balance with regard to initial gas pressurization.

Figure 19:
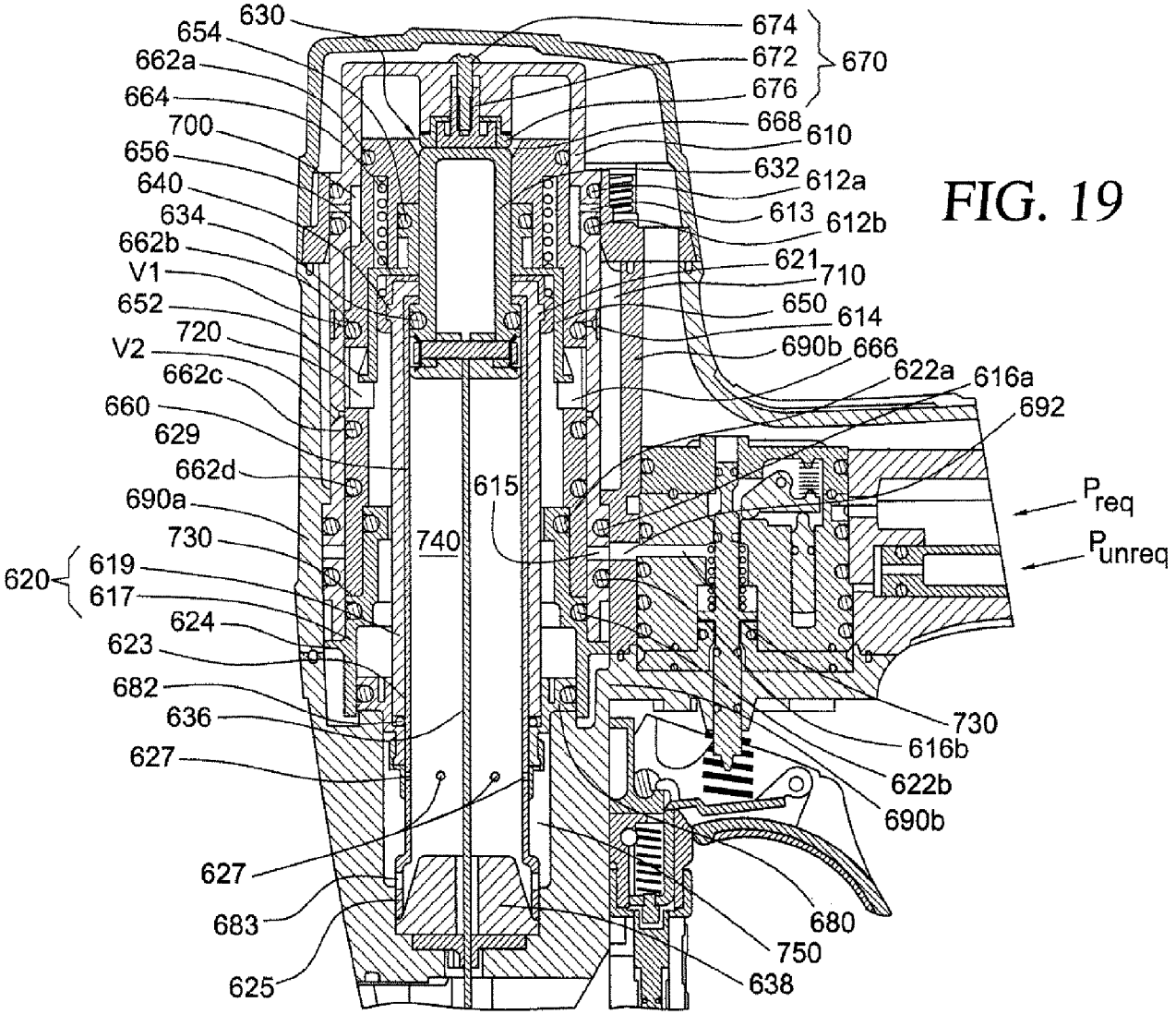
FIG. 19 is an enlarged sectional view of the exemplary drive engine according to the present invention.

Referring to FIG. 19, fastener driving device 100 also includes drive engine 600 having various structural members that define several volumes, including a knockdown volume 700, a holding volume 710, a reservoir volume 720, a bladder volume 730, a cylinder volume 740, and a plenum volume 750. Drive engine 600 and trigger valve module 500 control the flow of gas into and out of the various volumes to effectively and efficiently control the operation of fastening driving device 100 as described herein below.

Drive engine 600 is generally positioned in primary housing section 120 and extends into both engine cap 144 and nose assembly section 142. Drive engine 600 includes stationary structural components including a bulkhead 610, a sleeve assembly 620, a cylinder 629, a cylinder seal 640, a sleeve plug 680 and an internal support 800.

As shown in FIG. 19, sleeve plug 680 is positioned in abutment with nose assembly housing 146 and extends into a lower cavity 681. Sleeve assembly 620 includes an outer sleeve 617 extending annularly around the outside of sleeve plug 680 and an inner sleeve 619 formed integrally with outer sleeve 617 (FIG. 22B) and positioned inside sleeve plug 680. The upper portion of inner sleeve 619 is cylindrical shaped and extends upwardly into bulkhead 610. The upper portion of inner sleeve 619 also includes an annular protrusion 621 along an exterior surface near the distal end of inner sleeve 619. Cylinder seal 640 includes an inner groove for receiving annular protrusion 621 to securely attach cylinder seal 640 to inner sleeve 619. Inner sleeve 619 also includes a lower portion 623 that is sealed against sleeve plug 680 by a seal ring 682. Outer sleeve 617 also extends upwardly into bulkhead 610 to sealingly engage the inner wall of bulkhead 610 via a seal ring 622*b*. Moreover, outer sleeve 617 includes a ledge portion 624 contacting a distal end of bulkhead 610.

Cylinder 629 is securely positioned in inner sleeve 619 and includes a lower portion 625 extending into lower cavity 681 to abut a bumper 638. Flow ports 683 and relief ports 627 formed in the lower end of liner 629 permit gas flow between cylinder volume740 and plenum volume 750.

Bulkhead 610 includes upper seal rings 612*a* and 612*b*, a check seal 614, and lower seal rings 616*a* and 616*b*. Upper seal rings 612*a* and 612*b* are disposed on opposing sides of a first gas passage 613 extending through bulkhead 610 and into knockdown volume 720. Check seal 614 is disposed along an outer circumference of bulkhead 610 and is positioned between a first vent port V1 and holding volume 710. In addition, bulkhead 610 includes a second vent port V2 positioned adjacent to holding volume 710. Lower seal rings 616*a* and 616*b* are disposed on opposing sides of a second gas passage 615 that passes through bulkhead 610 and into bladder volume 730. Second gas passage 615 is aligned with housing passage 692, formed in primary housing section 120, which is aligned with gas passage 529 of trigger valve module 500 (FIG. 14).

As shown in FIG. 19, drive engine 600 also includes movable components that function to control gas flow and drive fasteners. Specifically, drive engine 600 includes a drive valve assembly including an outer headvalve 660 and an inner headvalve 650. Outer headvalve 660 is mounted in bulkhead 610 for reciprocal movement between upper (closed) and lower (open) positions. Outer headvalve 660 includes a central bore for receiving a piston driver assembly 630. Drive engine 600 also includes an inner headvalve 650 mounted in outer headvalve 660 and including an upper portion 651 having a central bore for receiving piston driver assembly 630. Inner headvalve 650 further includes a foot portion 652 and a shoulder portion 656 disposed between upper portion 651 and foot portion 652. Shoulder portion 656 contacts an upper surface of the cylinder seal 640 to define a boundary of reservoir volume 720. A bias spring 664, having a lower end positioned against shoulder portion 656 of inner headvalve 650 biases inner headvalve 650 into the lowermost position shown in FIG. 19. Inner headvalve 650 includes a seal ring 654 disposed between upper portion 651 and an inner surface of outer headvalve 660. Inner head valve is mounted for reciprocal movement between a closed position with shoulder portion 656 in sealing abutment against cylinder seal 640 and an open position with shoulder portion 656 spaced from cylinder seal 640. Outer headvalve 660 includes an upper seal ring 662*a* disposed between upper portions of outer headvalve 660 and bulkhead 610, and first, second, and third middle seal rings 662*b*, 662*c*, and 662*d*. In addition, outer headvalve 660 includes an opening 666 receiving foot portion 652 of inner headvalve 650 between first and second middle seal rings 662*b* and 662*c*. A lower distal end of outer headvalve 660 is positioned in an annular gap formed between the upper portion of outer sleeve 617 and bulkhead 610, and sealed by a seal ring 622*a*.

Exhaust assembly 670 includes an exhaust seal 676 attached to a boss formed on the inner surface of bulkhead 610 via a mounting clip 672 and fastener 674. Exhaust seal 676 is positioned opposite the central bore 668 of outer headvalve 660 so as to provide an annular seal against the inner surface of the central bore 668 when outer headvalve 660 moves upward into the upper position.

Piston-driver assembly 630 includes a piston 632 having a lower portion sealed against an inner surface of cylinder 629 by a seal ring 634, and an upper portion having a shape that is complementary to the space within inner and outer headvalve 650 and 660 (bore 668) below exhaust seal 676. By occupying substantially all of this space, piston 632 minimizes the dead volume/space required for pressurizing during a drive event of the piston, thereby more efficient use of the regulated gas and maximizing the number of fasteners driven per cartridge. Piston-driver assembly 630 further includes a drive element 636 extending from the lower portion of the piston 632 within cylinder volume 740 and protruding through bumper 638 to drive fasteners fed from magazine system 150 (FIG. 1). Piston-driver assembly 632 is mounted for reciprocal movement between an upper retracted position and a lower, extended position by moving through a retraction stroke and a driving stroke.

The knockdown volume 700 is defined by a space between an inner portion of bulkhead 610 and an outer portion of outer headvalve 660. The holding volume 710 is defined by a space between an outer portion of bulkhead 610 and a first inner portion 690*a* of primary housing section 120. In addition, spaces between the inner portion of bulkhead 610 and outer portions of outer sleeve 617 define reservoir volume 720. Also, plenum volume 750 is defined by interconnected segments disposed between each of inner sleeve 619, outer sleeve 617, and bulkhead 610 and a second inner portion 690*b* of internal drive engine housing 690.

Bladder volume 730 is defined as a space between lower end of outer headvalve 660 and an outer surface of outer sleeve 617, as well as a space within valve module 501 with trigger valve stem 510 in a resting position, i.e. not actuated by trigger 148 (FIG. 1). The space within valve module 501 may be generally characterized as a first space defined between upper and lower seal ring 512*a* and 512*d* of trigger valve stem 510 and a second space between and within gas passage 529 and the first space.

In addition, FIG. 19 shows valve module 501 and corresponding regulated and unregulated gas flow provided at respective pressures $P_{reg}$ and $P_{unreg}$ provided to valve module 501 from gas management system 300 (FIG. 6B). As a result, various processes are initiated within drive engine 600, as detailed below.

Figure 20:
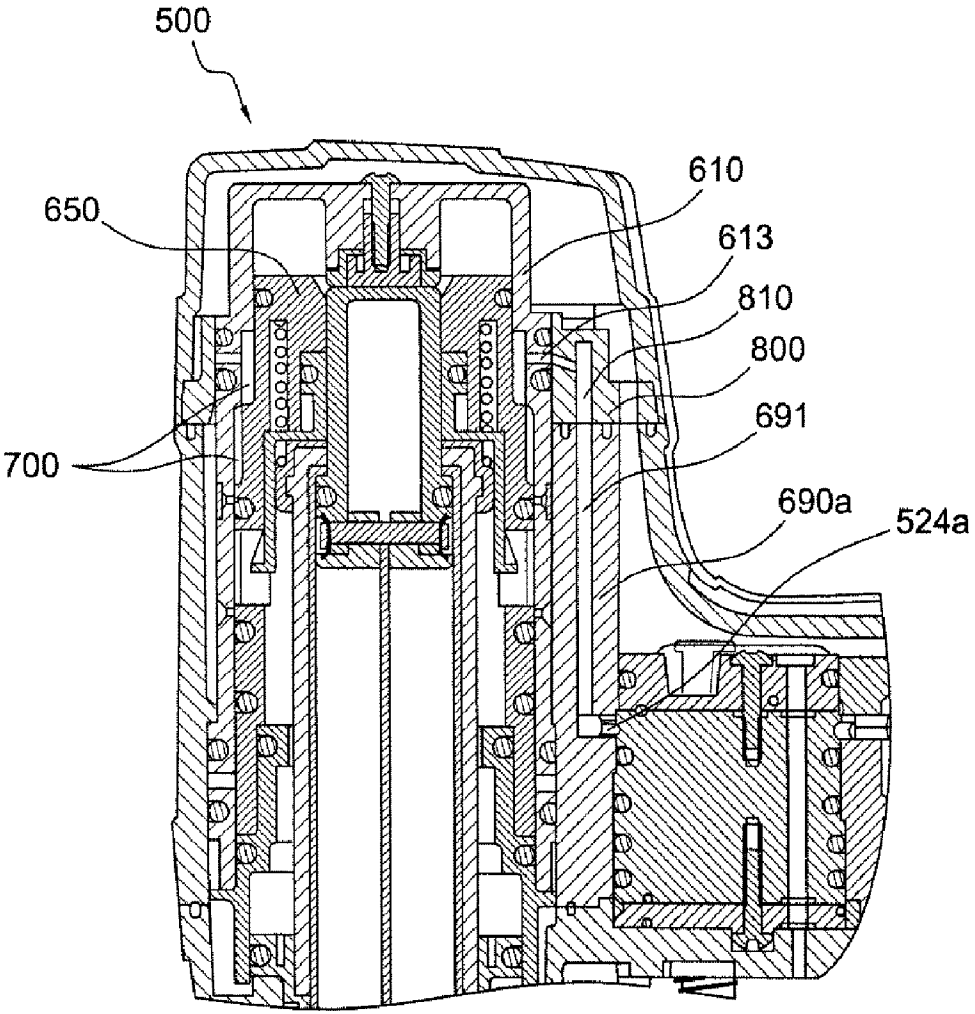
FIG. 20 is a first sectional view of the drive engine during an exemplary initialization process according to the present invention.

FIGS. 20-25 are sectional views of drive engine of FIG. 19 showing part of an exemplary initialization process of fastener driver system according to the present invention with cartridges C1 and C2 loaded in containment system 200 and trigger 148 not actuated by a user. In FIG. 20, regulated gas provided to valve module 501 flows through upper outlet port 118*e* around upper annular passage 524*a*. Accordingly, regulated gas then flows upwardly through a passage 691 formed in primary housing section 120, through a passageway 810 formed in internal support 800 and into knockdown volume 700 via first gas passage 613. Regulated gas fills knockdown volume 700, and exerts a downward force upon outer headvalve 660, thereby moving outer headvalve 660 downward.

Figure 21:
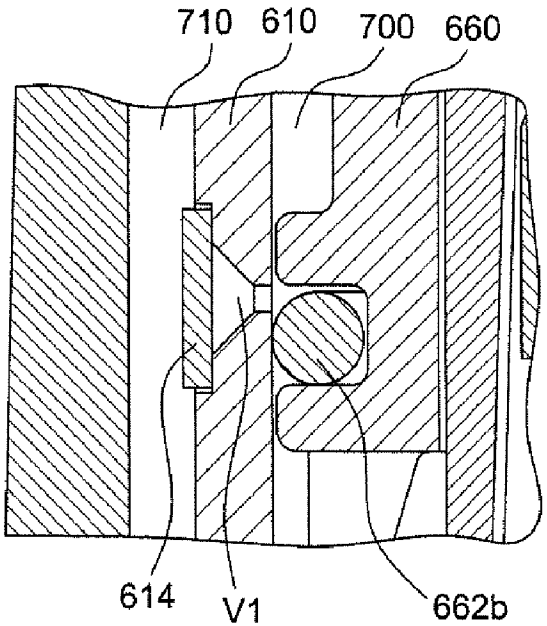
FIG. 21 is a second sectional view of the drive engine during the exemplary initialization process according to the present invention.

Referring FIG. 21, as outer headvalve 660 moves downward past vent V1, vent port V1 is unsealed by first middle seal ring 662*b*. Accordingly, pressure exerted by knockdown volume 700 opens check seal 614, and allows regulated gas flow to begin filling and pressurizing holding volume 710.

Figure 22B:
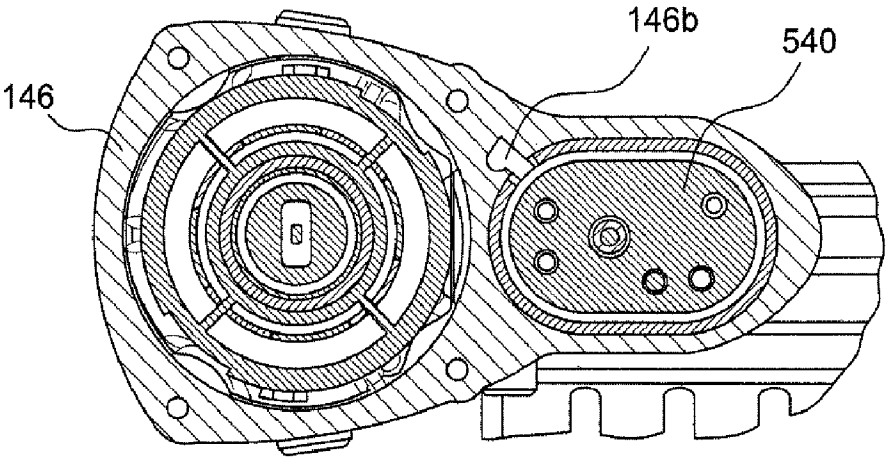
FIGS. 22A and 22*b* are third and forth sectional views of the drive engine during the exemplary initialization process according to the present invention.
Figure 22A:
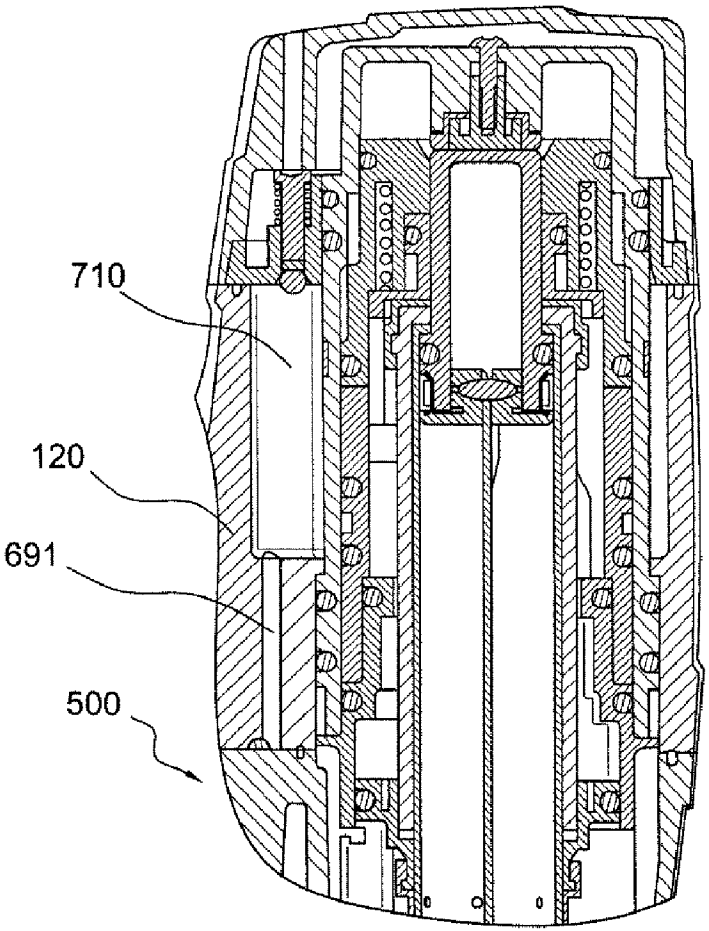
Figure 23:
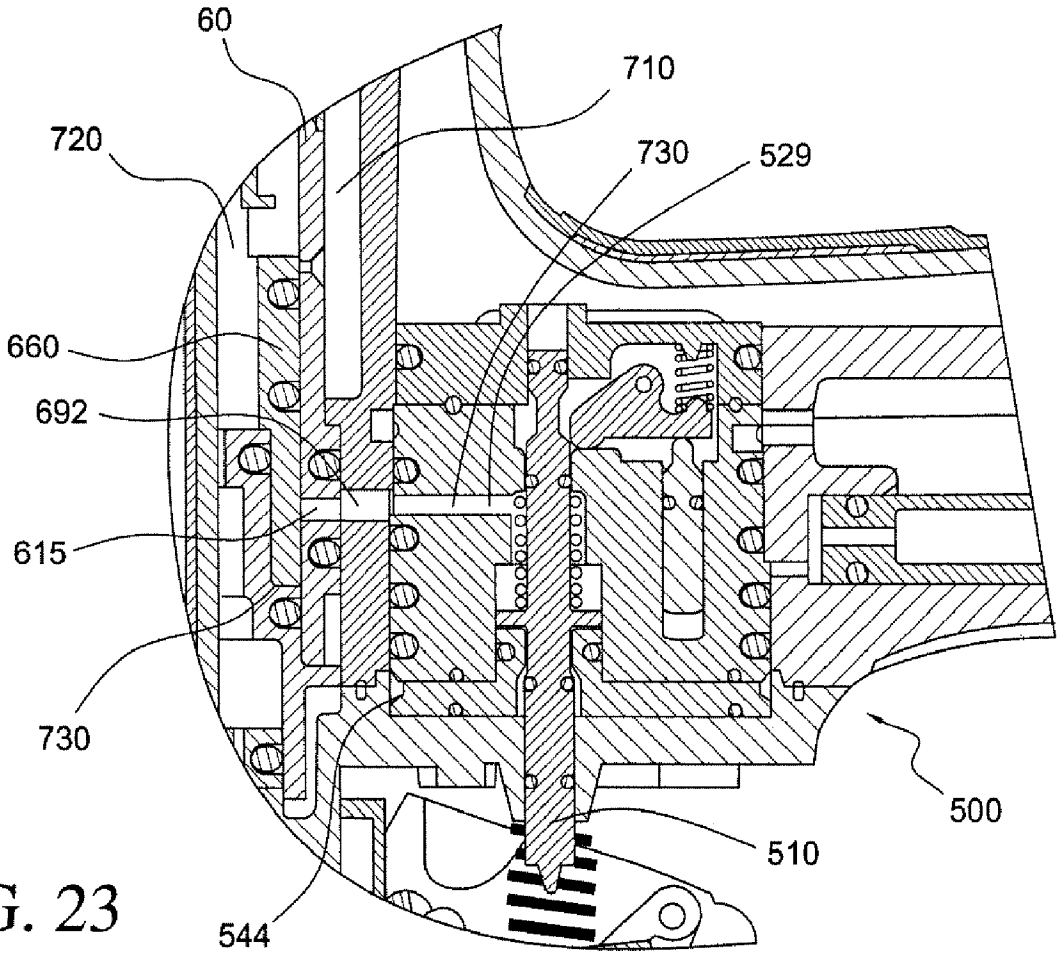
FIG. 23 is a fifth sectional view of the drive engine during the exemplary initialization process according to the present invention.

In FIGS. 22A and 22B, almost simultaneously with filling of holding volume 710, regulated gas flow also begins to flow downward through passage 691 of primary housing section 120 and into valve module 501 via a clearance passage 146*b* formed in nose assembly housing 146. Clearance passage 146*b* is aligned with passage 544 formed in valve cap 540 of valve module 501 (FIG. 15A). Accordingly, as shown in FIG. 23, with trigger valve stem 510 (FIG. 15A) in rest/non-actuated position, holding and bladder volumes 710 and 730 are open to each other, and regulated gas flow begins to fill bladder volume 730. Specifically, with lower seal ring 512*b* not sealed against lower portion 543*b* of valve cap 540, i.e. seal ring 512*b* in an open position, regulated gas flows upward along trigger valve stem 510 and into gas passage 529.

Figure 24:
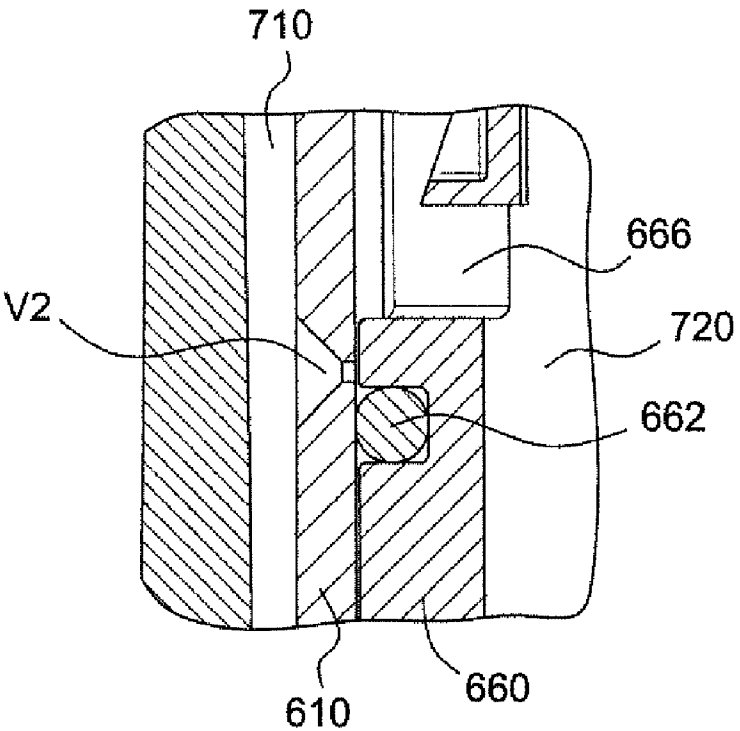
FIG. 24 is a sixth sectional view of the drive engine during the exemplary initialization process according to the present invention.

In FIG. 24, almost simultaneously with filling of holding and bladder volumes 710 and 730, respectively, regulated gas flow also begins to flow through second vent port V2 and into reservoir volume 720 through opening 666 of outer headvalve 660. Accordingly, the filling process into holding, reservoir, and bladder volumes 710, 720, and 730 continues through first vent port V1 until the net force acting upon outer headvalve 660 changes from downward to upward primarily due to the pressure increase in bladder volume 730 and the resulting pressure induced force acting on the lower end of outer headvalve 660 in combination with pressure forces on outer headvalve 660 due to the pressure increase in reservoir volume720. Thus, when the net force slightly changes to an upward force, outer headvalve 660 begins to move upward slightly.

Figure 25:
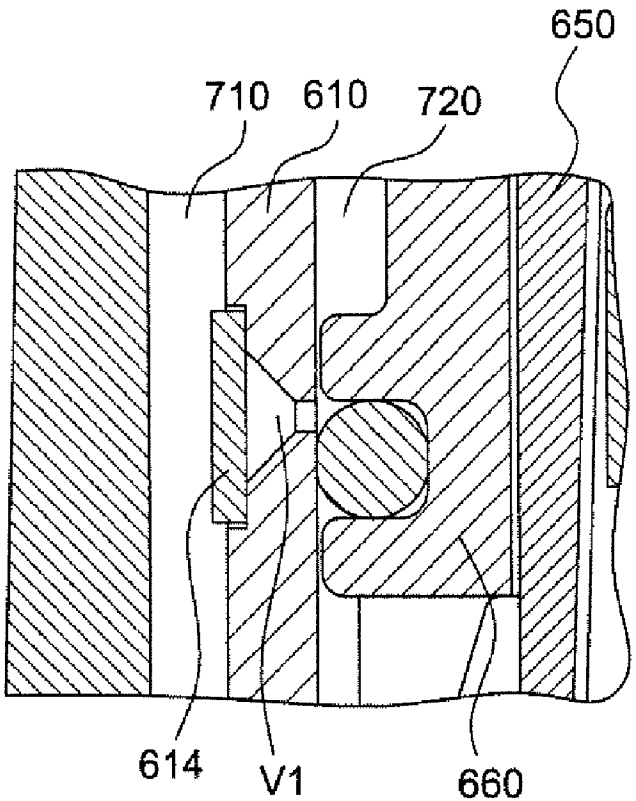
FIG. 25 is a seventh sectional view of the drive engine during the exemplary initialization process according to the present invention.

In FIG. 25, outer headvalve 660 has moved upward and first middle seal ring 662*b* is approaching first vent port V1. Once first middle seal ring 662*b* seals first vent port V1, the initialization process is completed.

As a result of the initialization process, pressure within knockdown volume 700 is approximately equal to regulated gas pressure $P_{reg}$. Moreover, since holding, reservoir, and bladder volumes 710, 720, and 730 are open to each other, pressure within holding, reservoir, and bladder volumes 710, 720, and 730 are approximately equal. In addition, since cylinder and plenum volumes 740 and 750 are both open to atmospheric pressure, both cylinder and plenum volumes 740 and 750 are approximately equal.

Figure 26:
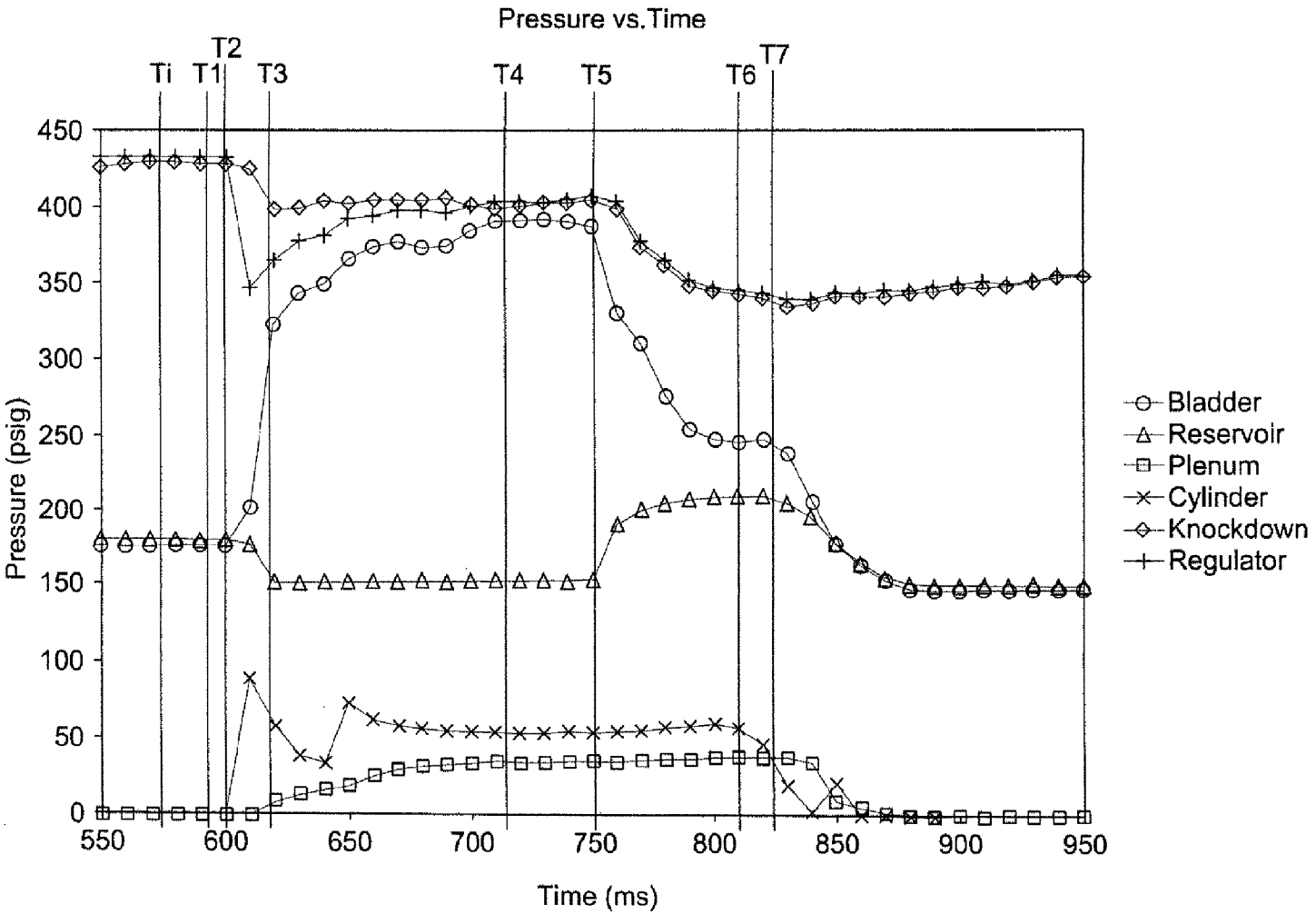
FIG. 26 is a graphical representation of various pressures during an exemplary process for operating the cordless fastener driving device according to the present invention.

FIG. 26 is a graphical representation of various relative pressures during an exemplary process for operating the fastener driving device according to the present invention. At a time $T_i$, the initialization process has been completed.

Figure 27B:
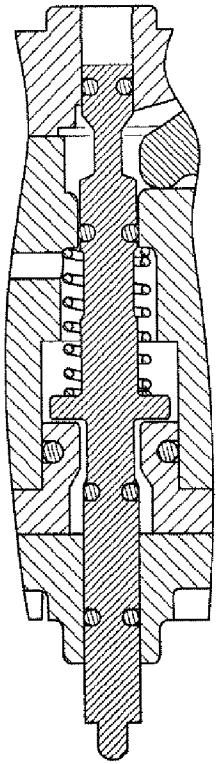
FIGS. 27A and 27B are sectional views of the exemplary drive engine and trigger valve stem at a time $T_i$ according to the present invention.
Figure 27A:
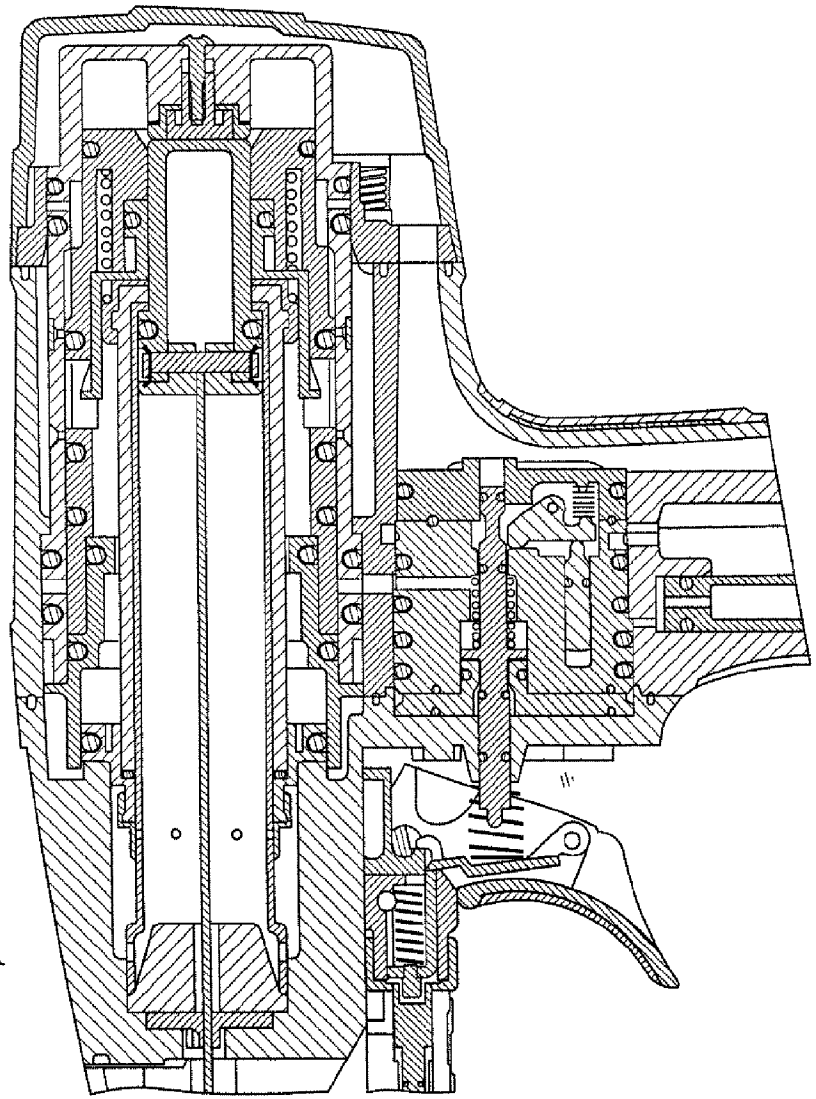

FIGS. 27A and 27B are sectional views of the drive engine 600 and trigger valve stem 510, respectively, at the time $T_i$ (in FIG. 26). In FIG. 27A, pressures within the various volumes are initialized as detailed above. In FIG. 27B, trigger valve stem 510 is in rest/non-actuated position. Upper seal ring 512*a* is in a closed position preventing regulated gas within first interior volume 528*a* from flowing around seal ring 512*a* and into bladder volume 730. Lower seal ring 512*b* is not engaged with upper portion 543*a* of valve cap 540, i.e., in an open position, thereby fluidically connecting holding and reservoir volumes 710 and 720 to bladder volume 730.

Figure 28B:
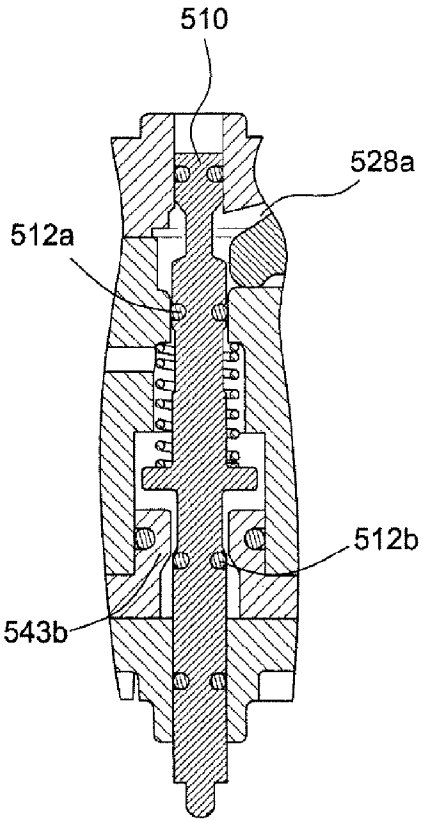
FIGS. 28A and 28B are sectional views of the exemplary drive engine and trigger valve stem at a time $T_1$ according to the present invention.
Figure 28A:
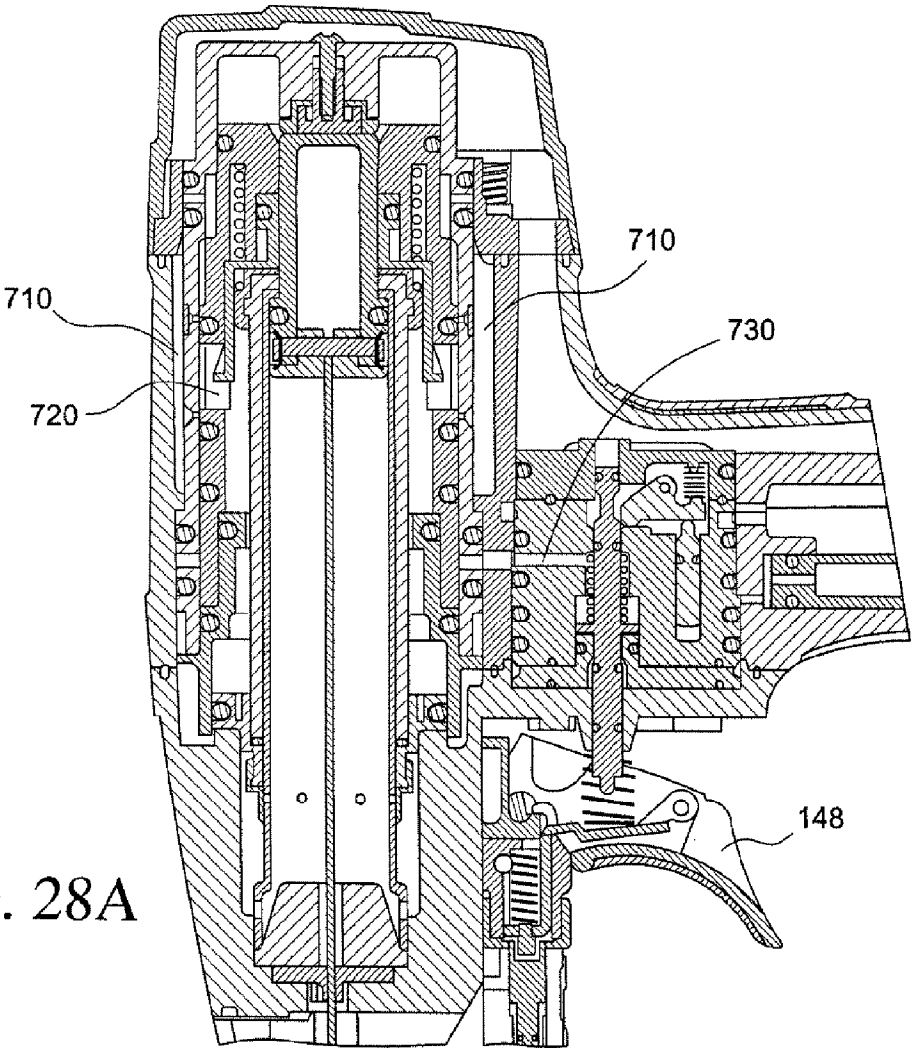

FIGS. 28A and 28B are sectional views of drive engine 600 and trigger valve stem 510, respectively, at the time T1 (FIG. 26). At the time T1, trigger valve stem 510 begins to travel in the upward direction into valve module 501 by actuation of trigger 148 by a user. Accordingly, lower seal ring 512*b* begins to engage upper portion 543*a* of valve cap 540, and upper seal ring 512*a* is still in a closed position. Therefore, valve module 501 is designed to ensure lower seal ring 512*b* is moved into a closed position before upper seal ring 512*a* moves into an open position thereby minimizing the amount of gas required to actuate outer headvalve 660 by preventing gas flow into holding and reservoir volumes 710 and 720.

Figure 29B:
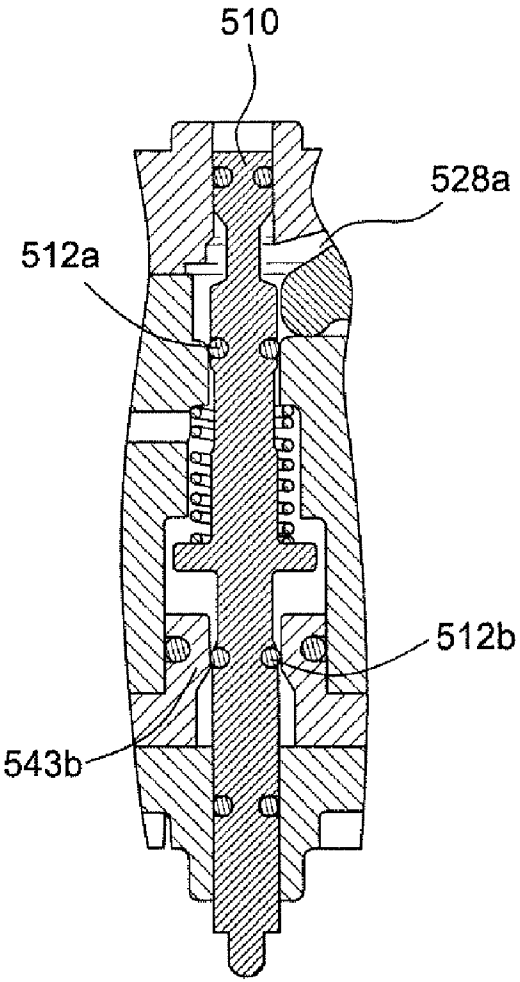
FIGS. 29A and 29B are sectional views of the exemplary drive engine and trigger valve stem at a time $T_2$ according to the present invention.
Figure 29A:
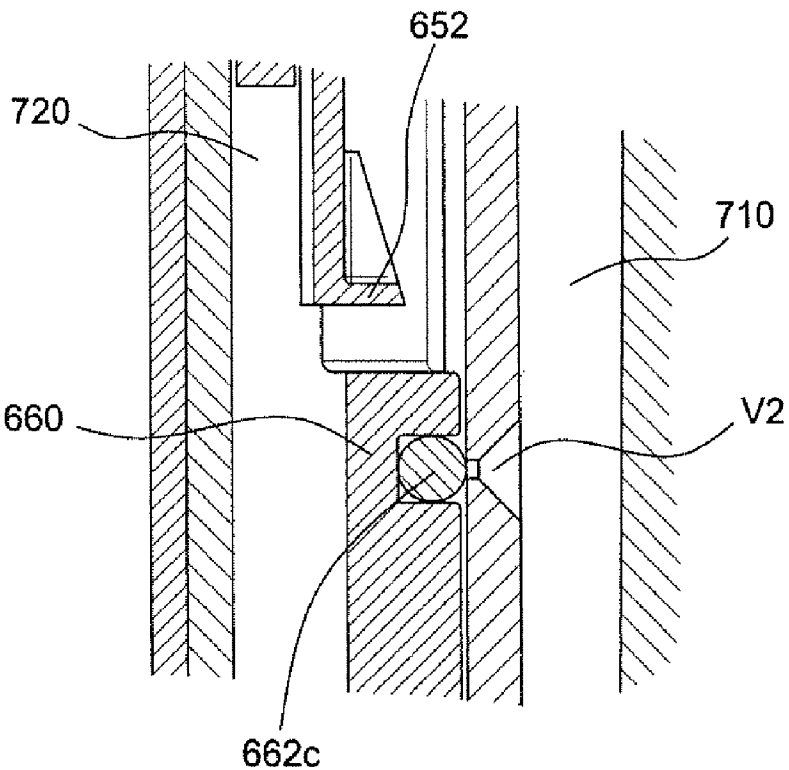
Figure 31:
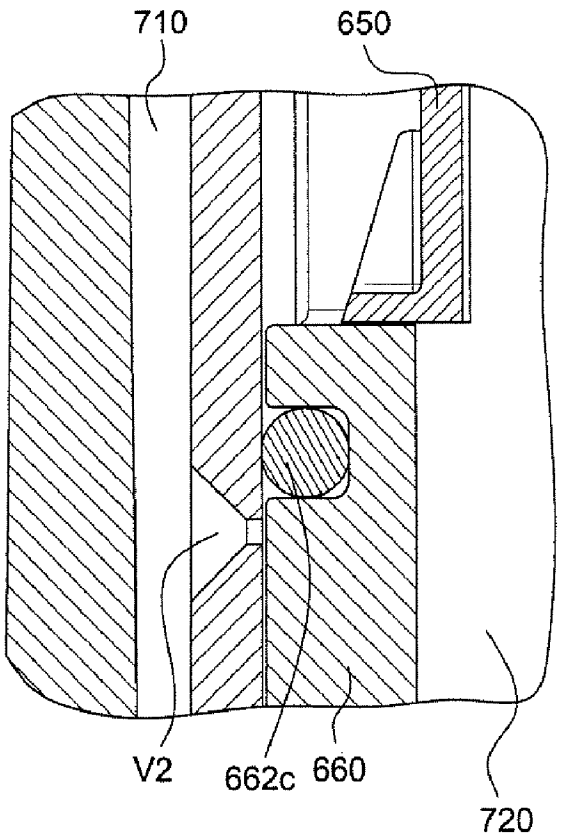
FIG. 31 is a sectional view of the exemplary drive engine during the time $T_2$ according to the present invention.
Figure 30:
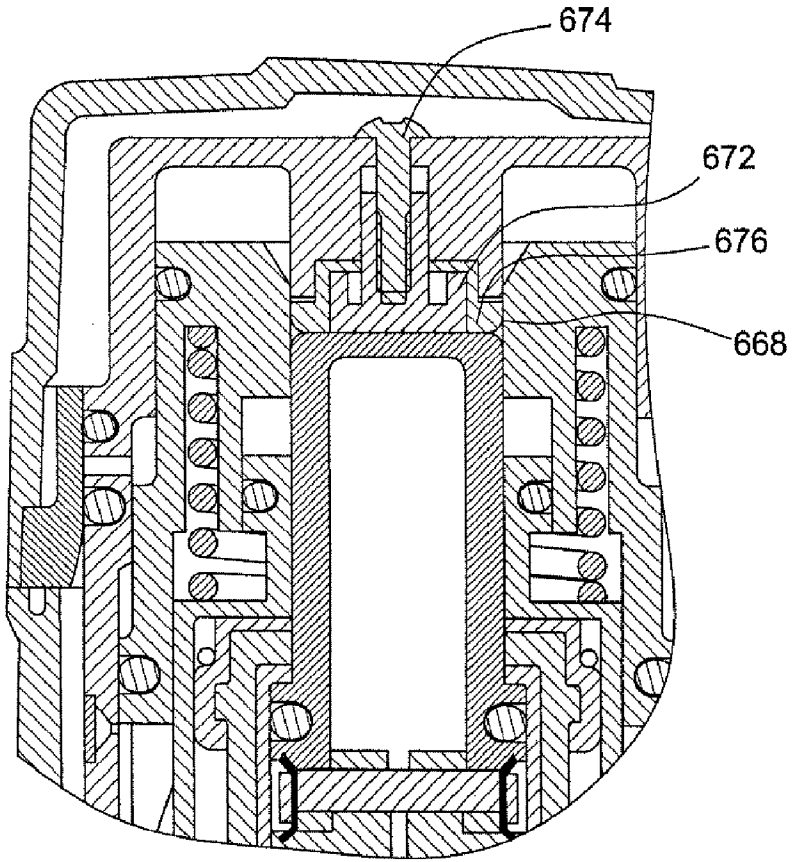
FIG. 30 is a sectional view of the exemplary drive engine during the time $T_2$ according to the present invention.

FIGS. 29-36 are sectional views of the drive engine during an exemplary process for operating the fastener driving device 100 according to the present invention. Specifically, FIGS. 29-31 are sectional views of the drive engine during the exemplary process at trigger actuation according to the present invention, and FIGS. 32-36 are sectional views of the drive engine during the exemplary process at piston driver actuation according to the present invention.

FIGS. 29A and 29B are sectional views of drive engine 600 and trigger valve stem 510, respectively, at the time T2 (FIG. 26). During the time T2, trigger valve stem 510 travels further in the upward direction in the valve module 501 by further actuation of trigger 148 by the user. Accordingly, lower seal ring 512*b* fully engages upper portion 543*a* of valve cap 540, i.e. moves to the closed position, and upper seal ring 512*a* begins to disengage from valve manifold 520, i.e., moves to an open position, to release regulated gas held within first interior volume 528*a*. Regulated gas begins to fill bladder volume 730, and pressure within bladder volume 730 will increase to substantially equal regulated gas pressure $P_{reg}$.

As a combined result of pressure increase in bladder volume 730, net force on outer headvalve 660 acts in an upward direction on outer headvalve 660 causing outer headvalve 660 to move upward. Accordingly, a sequence of events is simultaneously initialized, as detailed below with regard to FIGS. 29A-31. In FIGS. 29A and 29B, further during the time T2 (FIG. 26), outer headvalve 660 moves upward, thereby closing second vent port V2 by second middle seal ring 662*c*. Accordingly, reservoir volume 720 is isolated from holding volume 710.

In FIG. 30, further during the time T2 (FIG. 26), as outer headvalve 660 moves further upward, exhaust seal 676 seals against central bore 668 of outer headvalve 660. Next, outer headvalve 660 engages foot portion 652 of inner headvalve 650 and lifts inner headvalve 650 using foot portion 652. In turn, as headvalve 660 continues to move upward, shoulder portion 656 of the inner headvalve 650 will disengage from cylinder seal 640.

Figure 32:
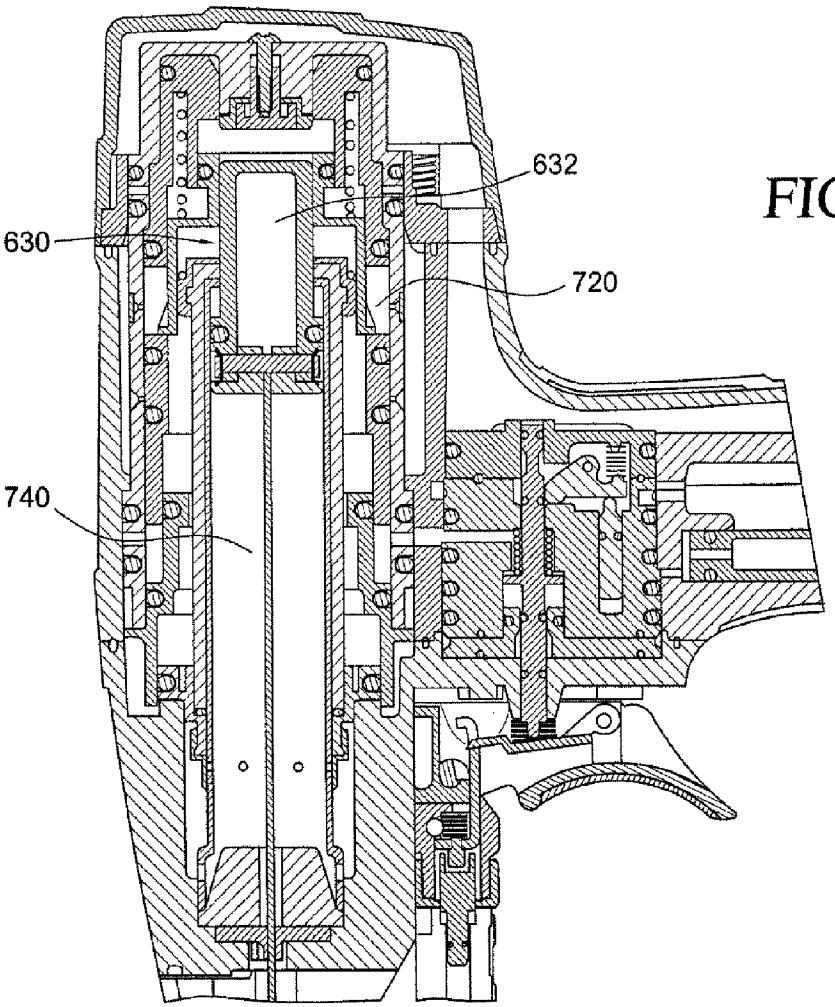
FIG. 32 is a sectional view of the exemplary drive engine at a time $T_3$ according to the present invention.

FIG. 32 is a sectional view of drive engine 600 at the time T3 (FIG. 26). In FIG. 32, outer headvalve 660 continues traveling upward until it contacts the top of bulkhead 610. Pressurized gas held in isolated reservoir volume 720 expands against piston 632 imparting energy to drive piston driver assembly 630 downward through cylinder volume 740 and toward bumper 638.

Figure 33:
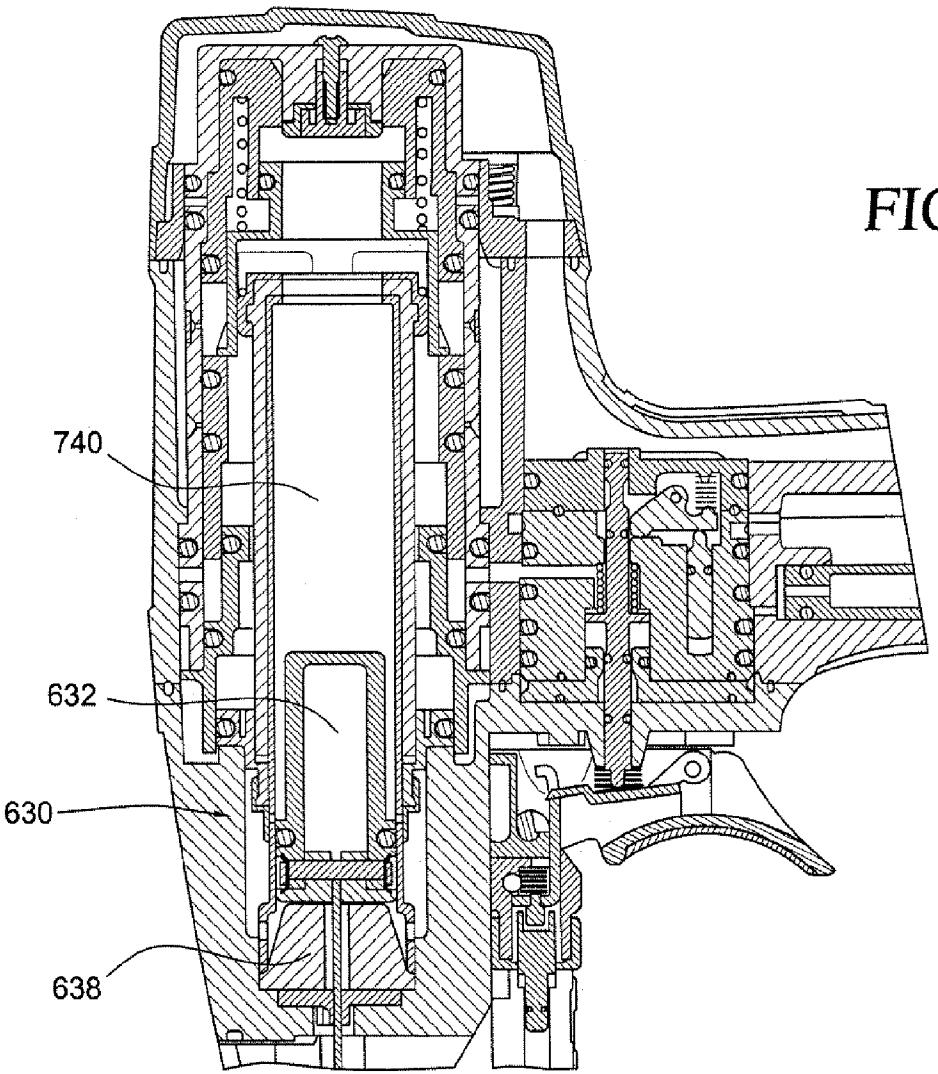
FIG. 33 is a sectional view of the exemplary drive engine at a time $T_4$ according to the present invention.

FIG. 33 is a sectional view of drive engine 600 at the time T4 (FIG. 26). In FIG. 33, once piston driver 630 has fully traveled downward through cylinder volume 740, a bottom portion of the piston driver assembly 630 is pressed against the bumper 638. As a result, the fastener has been driven, and drive engine 600 is awaiting return to initialization. After the fastener is driven, the user releases the trigger 148 allowing trigger valve stem 510 to return to the rest/non-actuated position.

Figure 34B:
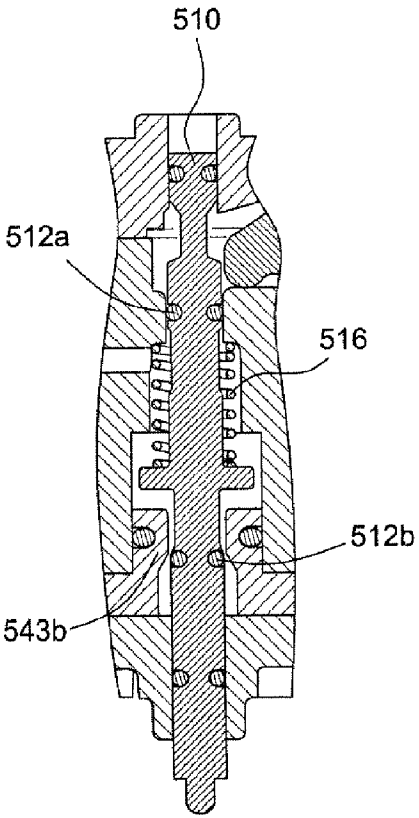
FIG. 34B is an expanded sectional view of the trigger valve stem at a time $T_5$ according to the present invention.
Figure 34A:
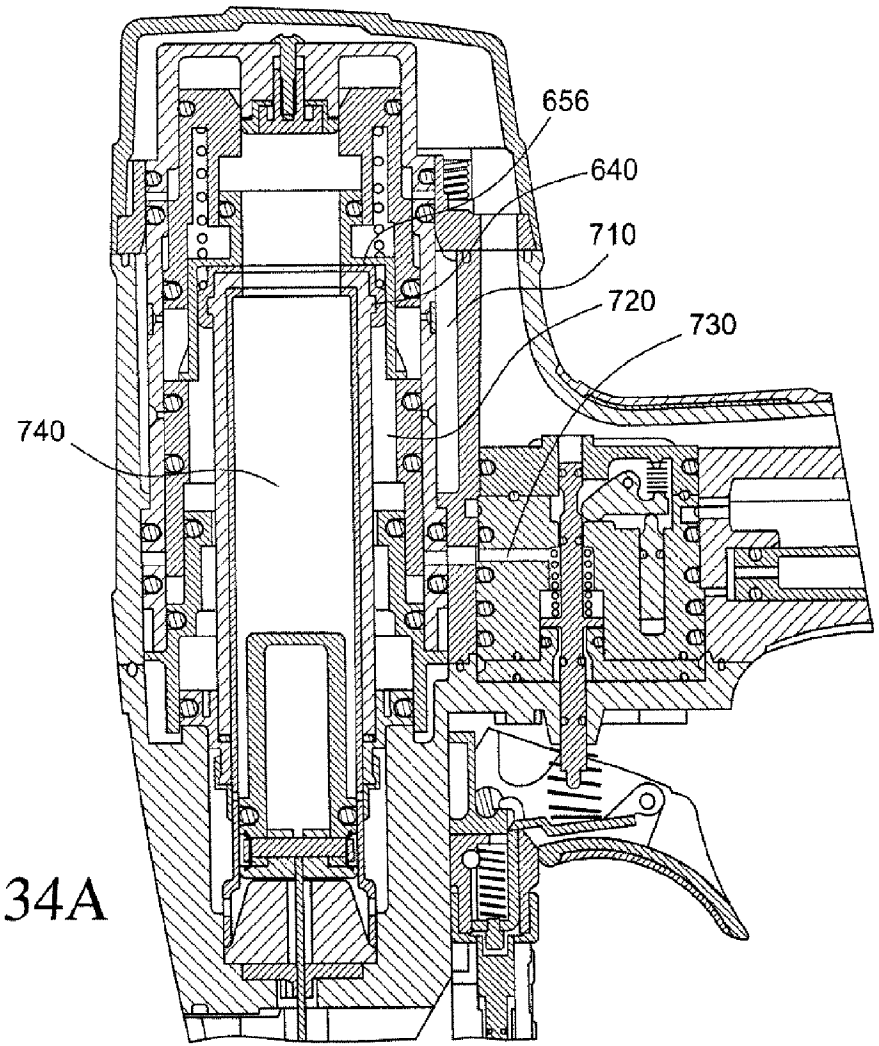
FIG. 34A is a sectional view of the exemplary drive engine at a time $T_5$ according to the present invention.

FIGS. 34A and 34B are sectional views of drive engine 600 and trigger valve stem 510, respectively, at the time T5 (FIG. 26). In FIG. 34, trigger 148 (FIG. 1) is released and trigger valve stem 510 begins to return to rest/non-actuated position, as shown in FIG. 15A. Trigger valve stem spring 516 causes trigger valve stem 510 to travel downward within valve module 501, wherein upper seal ring 512*a* seals against valve manifold 520 to isolate first interior volume 528*a*. Additionally, lower seal ring 512*b* begins to disengage from lower portion 543*b* of the valve cap 540 and connects bladder volume 730 to holding volume 710. Accordingly, higher pressure gas in bladder volume 730 expands into holding volume 710. Thus, the corresponding reduction in pressure in bladder volume 730, combined with the pressure decrease in reservoir volume 720, allows outer headvalve 660 to move downward.

In FIG. 34A, outer headvalve 660 continues to move downward to its initial position as pressure in bladder volume 730 is reduced. Inner headvalve 650 moves into the closed position against cylinder seal 640 blocking flow into cylinder volume 740. Accordingly, reservoir volume 720 is isolated from cylinder volume 740, and outer headvalve 660 continues downward.

Figure 35:
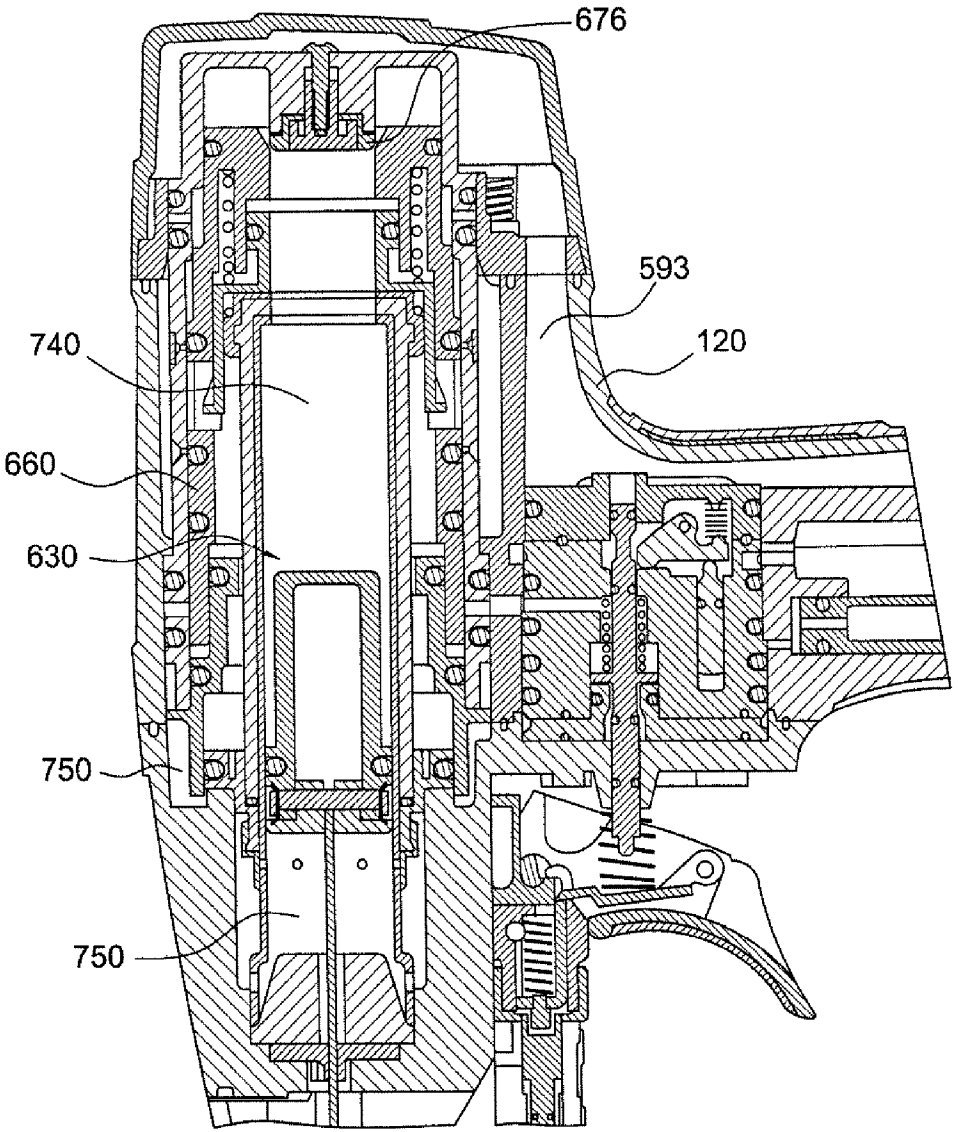
FIG. 35 is a sectional view of the exemplary drive engine at a time $T_6$ according to the present invention.

FIG. 35 is a sectional view of drive engine 600 at the time T6 (FIG. 26). In FIG. 35, as outer headvalve 660 continues to move downward, exhaust seal 676 opens to vent gas within cylinder volume 740 to atmosphere by flowing through an exhaust cavity/path 593 extending downwardly from engine cap 144 through primary housing section 120 above valve module 501 and cavity housing 114 over manifold 310 and out vents 591. Accordingly, as gas is vented, drive piston assembly 630 returns upward due to compressed gas within plenum volume 750. Thus, exhaust seal 676 opens to exhaust only gas in cylinder and plenum volumes 740 and 750 to atmosphere. Therefore, gas present in holding, reservoir and bladder volumes 710, 720 and 730 are not vented to atmosphere.

Figure 36:
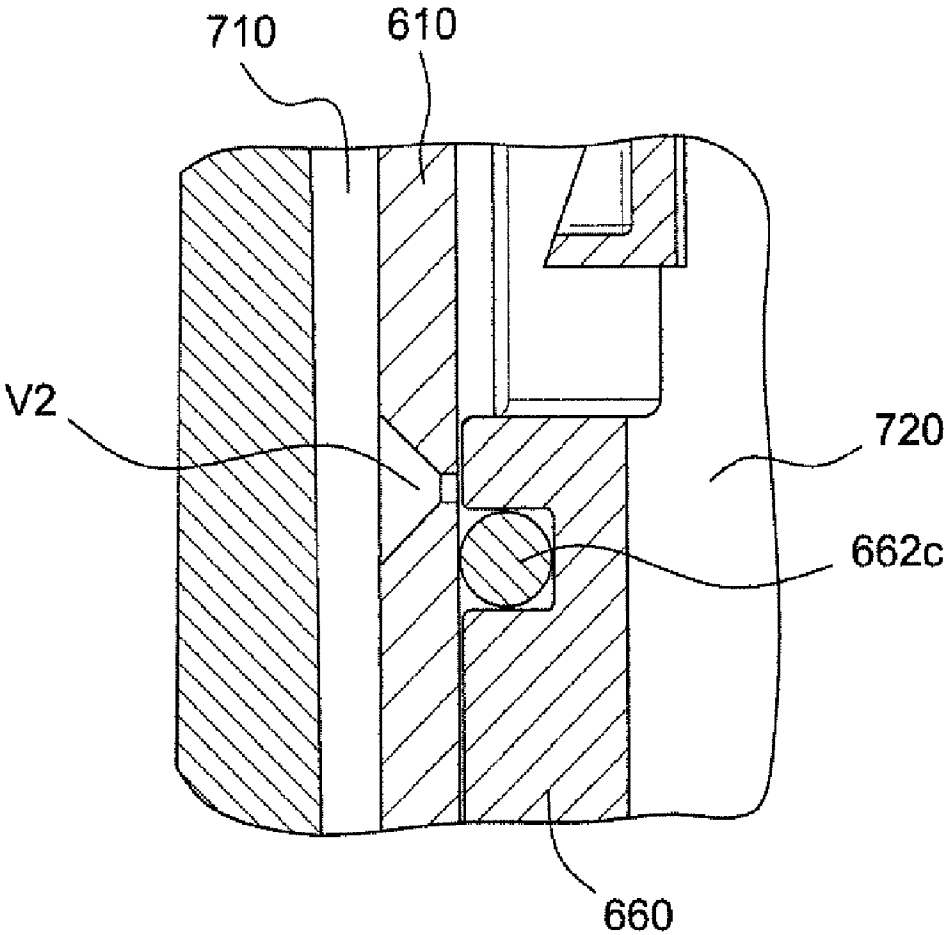
FIG. 36 is a sectional view of the exemplary drive engine at a time $T_7$ according to the present invention.

FIG. 36 is a sectional view of drive engine 600 at the time T7 (FIG. 26). In FIG. 36, as pressures within holding and bladder volumes 710 and 730 begin to equalize, outer head-valve 660 continues downward. Accordingly, middle seal ring 662*c* opens second vent port V2 of bulkhead 610, and allows holding and bladder volumes 710 and 730 to refill reservoir volume 720. Thus, pressures within each of holding, reservoir, and bladder volumes 710, 720, and 730 substantially equalize to a post actuation pressure.

If the post actuation pressure is less than the regulated pressure, then regulated gas will flow into knockdown volume 700 through first gas passage 613 of bulkhead 610. This is similar to the process of initialization, wherein pressures in holding, reservoir, and bladder volumes 710, 720, and 730 are initialized to the initialization pressure. Thus, fastener driving device 100 (FIG. 1) is now ready again for operation, as detailed with regard to FIGS. 21-36.

As a result of the detailed operation of the fastener driving device 100 (FIG. 1), only gas used from within reservoir volume 720 is used to drive piston driver 630 through cylinder volume 740 during a given driving cycle of drive engine 600, while holding volume 710 holds gas for delivery to reservoir volume 720 for the next cycle. Accordingly, a total volume of compressed gas exhausted to atmosphere after having driven a fastener is significantly less than the combined total of knockdown, holding, reservoir, and bladder volumes 700, 710, 720, and 730. Specifically, by recycling compressed gas provided within holding and bladder volumes 710 and 730 back through drive engine 600 after a fastener has been driven into a workpiece, the total amount of compressed gas actually used to drive the fastener is minimized. Thus, the present invention provides for highly efficient management and use of compressed gas supplied by cartridges C1 and C2 Therefore, the frequency with which cartridges C1 and C2 are replaced during prolonged use of the fastener driving device 100 (FIG. 1) is minimized. Consequently, device 100 maximizes the use of the stored energy in the compressed gas thereby maximizing the number of fasteners driven per compressed gas cartridge.

We claim:

1. A fastener driving device for driving a fastener into a workpiece, comprising:

a device body;

a cartridge containment system mounted on said device body to load and unload at least one gas cartridge;

a gas management system positioned in the device body adjacent to the cartridge containment system to receive compressed gas provided by the at least one gas cartridge and to regulate, and direct regulated and unregulated flows of pressurized gas;

a valve system mounted in the device body to receive and control the pressurized gas flow from the gas management system, the valve system comprising a trigger valve and a low pressure lock-out system that prevents actuation of the trigger valve when pressure of the unregulated flow of pressurized gas from the at least one cartridge is insufficient to drive a fastener; and a drive engine mounted in the device body to receive and control the regulated pressurized gas flow, the drive engine comprising a gas storage volume surrounding an exterior of a cylinder, the gas storage volume providing a volume of regulated pressurized gas to an interior of the cylinder of the drive engine.

2. The device of claim 1, wherein the cartridge containment system receives a plurality of gas cartridges in side by side relationship.

3. The device of claim 1, wherein the cartridge containment system includes a containment knob mounted to receive the at least one gas cartridge, said containment knob mounted for rotation to cause the at least one gas cartridge to move into a loaded position.

4. The device of claim 1, wherein the cartridge containment system includes a plurality of lance assemblies, at least one of said plurality of lance assemblies mounted for movement by gas pressure to cause piercing of at least one of the at least one gas cartridge.

5. The device of claim 1, wherein said gas management system includes a manifold positioned within the device body, a regulator assembly mounted on said manifold, and a flow tube connected to said manifold for delivering gas to said valve system.

6. The device of claim 1, wherein said gas management system includes a manifold and a regulator assembly mounted on said manifold, said cartridge containment system including at least one lance assembly mounted on said manifold for receiving and piercing an end of a gas cartridge.

7. The device of claim 6, wherein said at least one lance assembly includes a first lance assembly and a second lance assembly extending axially along the device body, said regulator assembly positioned between said first and said second lance assemblies and extending transverse to said first and said second lance assemblies.

8. The device of claim 1, wherein said gas management system further includes a regulator assembly with integral gas pressure regulation, gas pressure indication and over-pressure protection.

9. The device of claim 8, wherein said regulator assembly includes an adjustment knob mounted on one side of the device body and a fuel indicator extending to an opposite side of the device body.

10. The device of claim 8, wherein the regulator assembly includes at least one supply port and a check seal for allowing gas entry into the at least one supply port and for blocking gas flow back out through the at least one supply port.

11. The device of claim 1, wherein said valve system is formed as a module containing the trigger valve and a high pressure relief system.

12. The device of claim 11, wherein said module further contains a pressure rebalancing system.

13. The device of claim 11, wherein said module includes the low pressure lock-out system.

14. The device of claim 1, wherein said trigger valve has a trigger valve stem that is substantially pressure balanced to minimize actuation force by a user to actuate the trigger valve.

15. The device of claim 1, wherein said drive engine further includes an exhaust assembly, a piston-driver assembly mounted for reciprocal movement in the cylinder, an outer headvalve mounted for movement between a closed position blocking flow through said exhaust assembly and an open position permitting gas flow through said exhaust assembly.

16. The device of claim 15, wherein said drive engine further includes an inner head valve mounted for reciprocal movement between a closed position blocking flow from the cylinder and an open position permitting flow from the cylinder.

17. The device of claim 16, wherein said outer headvalve contacts the inner headvalve to move the inner headvalve from the closed position to the open position.

18. The device of claim 16, wherein said inner headvalve is mounted in a central bore of said outer headvalve.

19. The device of claim 15, wherein said drive engine further includes a bladder volume positioned adjacent said outer headvalve for receiving regulated gas flow for moving said outer headvalve from said open to said closed position.

20. The device of claim 15, wherein the drive engine comprises a plurality of volumes configured to reduce the pressure of the compressed gas prior to delivering the gas to the piston-driver assembly to move the piston-driver assembly through a drive stroke.

21. The device of claim 1, wherein said valve system includes a trigger valve module for receiving both a regulated gas flow and an unregulated gas flow from the gas management system.

22. The device of claim 1, wherein said drive engine further includes a holding volume for holding a volume of regulated gas for delivery to the reservoir volume after the one cycle for delivery to the cylinder during the next cycle of the drive engine.

23. The device of claim 1, wherein the device body includes a magazine section configured to carry a plurality of fasteners to be driven by the device, the magazine section comprising at least one cartridge storage member for storing a spare gas cartridge.

24. A fastener driving device for driving a fastener into a workpiece, comprising:

a device body;

a cartridge containment system on the device body to load and unload at least one compressed gas cartridge;

a cylinder within the device body;

a piston and driver movable with respect to the cylinder;

a gas storage volume that is arranged to receive compressed gas from a cartridge when the cartridge is loaded in the cartridge containment system and that is arranged to supply a stored volume of gas to the piston for driving the piston through a fastener drive stroke; and a valve system including a first valve and a second valve, the first valve being in a closed position and the second valve being in an open position to enable the gas storage volume to be filled with compressed gas, the first valve being moved from the closed position to an open position to permit the stored volume of gas to travel from the gas storage volume to the piston to move the piston and driver with respect to the cylinder through the fastener drive stroke, and the second valve being upstream from the gas storage volume and being in a closed position as gas travels from the gas storage volume to the piston to limit an amount of gas that travels to the piston to no greater than the stored volume during the fastener drive stroke.

25. The device of claim 24, wherein the first valve and the second valve are configured to be actuated by the compressed gas from the cartridge containment system prior to the gas being stored in the gas storage volume for subsequent delivery to the piston.

26. The device of claim 24, further comprising a holding volume that receives compressed gas from the cartridge containment system and that supplies the compressed gas to the storage volume, the second valve being located between the holding volume and the storage volume.

27. The device of claim 26, further comprising a bladder volume that receives regulated gas from the cartridge containment system to actuate the first valve and the second valve, the bladder volume being in fluid communication with the holding volume after the first valve is moved to the open position so that the regulated gas expands into the holding volume and causes the first valve to return to the closed position and the second valve to return to the open position.

28. The device of claim 27, further comprising a trigger valve having a trigger valve stem configured to be moved between a first position and a second position, wherein when the trigger valve stem is in the first position, the holding volume and the bladder volume are in fluid communication with each other, and wherein when the trigger valve stem is in the second position, the bladder volume is 1) in fluid communication with the cartridge containment system and receives the regulated gas from the cartridge containment system, and 2) not in fluid communication with the holding volume.

29. The device of claim 28, wherein the trigger valve stem is also configured to be moved to a third position that is in between the first position and the second position, and wherein when the trigger valve stem is in the third position, the bladder volume is not in fluid communication with the cartridge management system or the holding volume.

30. A gas actuated device having a gas management valve system, comprising:

a device body;

a cartridge containment system on the device body to load and unload at least one pressurized gas cartridge;

a gas storage volume that is arranged to receive compressed gas from a cartridge when the cartridge is loaded in the cartridge containment system and that is arranged to supply a stored volume of gas to a gas actuated mechanism to be actuated;

a valve system including a first valve and a second valve, the first valve being moved from a closed position to an open position to permit the stored volume of gas to travel from the gas storage volume to the gas actuated mechanism, the second valve being upstream from the gas storage volume and being closed as the gas travels from the gas storage volume to the gas actuated mechanism to limit an amount of gas that travels to the mechanism to no greater than, the stored volume; and a holding volume, wherein the compressed gas is used to open and close the first and second valves and is subsequently directed to the holding volume, and wherein gas from the holding volume is directed to the gas storage volume for subsequent actuation of the gas actuated mechanism.

31. The gas actuated device of claim 30, wherein the gas actuated device a fastener driving device, and wherein the gas actuated mechanism is a drive engine comprising a piston and a driver configured to drive a fastener into a workpiece.

* * * * *